US006491092B2

(12) United States Patent
Nakado et al.

(10) Patent No.: US 6,491,092 B2
(45) Date of Patent: Dec. 10, 2002

(54) HEAT EXCHANGER

(75) Inventors: Koji Nakado, Nishi-kasugai-gun (JP); Masashi Inoue, Nishi-kasugai-gun (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/948,648

(22) Filed: Sep. 10, 2001

(65) Prior Publication Data

US 2002/0017382 A1 Feb. 14, 2002

Related U.S. Application Data

(62) Division of application No. 09/611,339, filed on Jul. 6, 2000.

(30) Foreign Application Priority Data

| | | |
|---|---|---|
| Jul. 14, 1999 | (JP) | 11-201014 |
| Aug. 2, 1999 | (JP) | 11-219346 |
| Aug. 3, 1999 | (JP) | 11-220549 |
| Aug. 3, 1999 | (JP) | 11-220550 |
| Aug. 3, 1999 | (JP) | 11-220551 |
| Aug. 5, 1999 | (JP) | 11-223111 |

(51) Int. Cl.[7] ..... F28D 1/02
(52) U.S. Cl. ..... 165/152; 165/179
(58) Field of Search ..... 165/179, 153, 165/174, 176, DIG. 464, DIG. 466; 62/525, 527; 29/890.053, 890.046

(56) References Cited

U.S. PATENT DOCUMENTS

| | | | | |
|---|---|---|---|---|
| 3,254,707 A | * | 6/1966 | Ferguson | 165/174 |
| 4,524,823 A | * | 6/1985 | Hummel et al. | 165/174 |
| 5,186,249 A | * | 2/1993 | Bhatti et al. | 165/174 |
| 5,465,783 A | * | 11/1995 | O'Connor | 165/174 |
| 5,718,284 A | | 2/1998 | Nishishita | |
| 5,806,586 A | * | 9/1998 | Osthues et al. | 165/174 |
| 5,826,648 A | | 10/1998 | Shimoya et al. | |
| 5,979,544 A | * | 11/1999 | Inoue | 165/153 |
| 6,220,342 B1 | * | 4/2001 | Nishishita et al. | 165/153 |

FOREIGN PATENT DOCUMENTS

| | | |
|---|---|---|
| DE | 92 18 615 | 11/1994 |
| DE | 195 19 312 | 11/1996 |

* cited by examiner

*Primary Examiner*—Henry Bennett
*Assistant Examiner*—Terrell McKinnon
(74) *Attorney, Agent, or Firm*—Oblon, Spivak, McClelland, Maier & Neustadt, P.C.

(57) ABSTRACT

The present invention relates to a heat exchanger in which a plate-shaped cooling medium flow portion (11) provides an internal cooling medium flow path inside by laminating two flat plates (13, 14) subjected to drawing and a cooling fin are alternately laminated, a cooling medium inlet (15) for allowing a cooling medium to flow into the cooling medium flow path and a cooling medium outlet (16) for allowing the cooling medium passing through the cooling medium flow path to flow out are formed in said two flat plates, and the cooling medium flowing from the cooling medium inlet to the cooling medium flow path is passed through said cooling medium flow path and is then allowed to flow out of the cooling medium outlet. According to the present invention, a bulged portion (18) protruding on the cooling medium flow path side is formed in the cooling medium flow portion by denting at least any one of these two flat plates from the outside, and a plurality of elliptical or oval cylindrical portions whose major diameter is oriented in the flow direction of the cooling medium are provided between these two flat plates by butting the top portion of this bulged portion to the opposite flat plate. Additionally, the number of the cylindrical portions is gradually decreased as the cooling medium flows downstream in the flow direction of the cooling medium.

9 Claims, 22 Drawing Sheets

HEAT EXCHANGER

BACKGROUND OF THE INVENTION

1. Field of the Invention

The present invention relates to a heat exchanger which constitutes a vehicle air conditioner. The present invention is based on Japanese Patent Application Nos. 11-201014, 11-219346, 11-220549, 11-220550, 11-220551, and 11-113111, the contents of which applications are incorporated herein by reference.

2. Description of the Prior Art

One example of the structure of a heat exchanger which is used as an evaporator in a vehicle air conditioner is shown in FIG. 25. This heat exchanger is known as a drawn cup type heat exchanger, which has becoming common recently and is configured so that a plate-shaped cooling medium flow portion 3 obtained by piling up substantially rectangular flat plates 1 and 2 which are subjected to drawing and cooling fins 4 bent into a wave shape are alternately laminated.

The flat plates 1 and 2 are brazed at the outer peripheral portions and the central portions in the cooling medium flow portion 3. As the result a U-shaped cooling medium flow path R which travels between a cooling medium inlet 5 provided at the upper portion and the lower portion and leads to a cooling medium outlet provided at the upper portion and is aligned parallel the cooling medium inlet 5, is formed within the cooling medium flow portion 3.

In this heat exchanger a cooling medium is distributed to each cooling flow portion 3 at the cooling medium inlet 5, and is vaporized in the process of passing through the cooling medium flow path R, and is then collected again at the cooling medium outlet 6. After that the collected cooling medium is discharged from the heat exchanger.

Incidentally, the following problems have been pointed for the above-mentioned structured heat exchanger.

(1) In a heat exchanger used as an evaporator, the dryness of the flowing cooling medium is not constant, but it gradually increases in the process of vaporization. Thus, for a flow path cross-sectional area along the direction of the cooling medium flow, the specific volume of the cooling medium is increased and the flow path resistance is increased as the cooling medium moves downstream of the flow path. Therefore, high heat conductivity cannot always be obtained in the entire heat exchanger under the present circumstances. Also pressure losses cannot always be controlled to small levels.

(2) The cooling medium inlet 5 forms a continuous space by laminating the cooling flow portion 3 as shown in FIG. 26. Thus, the cooling medium flowing into the heat exchanger is distributed to each cooling medium flow portion 3 in the process of flowing within this continuous space in the directions of the arrows in FIG. 26. However, in a conventional heat exchanger the cooling medium collectively flows into the cooling flow portion 3 positioned downstream in the direction of the flow of the cooling medium and the distribution of the cooling medium into each cooling medium flow portion 3 is not uniformly carried out. As a result, cooling medium is apt to stagnate, and in the cooling flow portion 3 positioned upstream side in the direction of the flow of the cooling medium, heat exchange is not sufficiently performed.

(3) The cooling medium flowing into the heat exchanger is distributed into each cooling medium flow portion 3 from a space formed by lamination of the cooling flow portions 3. However, since in the conventional heat exchanger the start portion of the cooling flow path leading to the space is narrower than the space, the cooling flow path R is rapidly reduced at this portion and pressure loss occurs. Also in the continuous space formed at the cooling medium outlet 6 the same phenomenon is occurs. That is, since the space formed at the cooling medium outlet 6 is wider than the end portion of the cooling flow path R, the cooling flow path R is rapidly enlarged at this portion and pressure loss occurs.

(4) The cooling medium flow portion 3 is formed by laminating two flat plates 1 and 2 which were subjected to drawing and brazing after providing the cooling medium portion R inside the plates. However, if the plates 1 and 2 are shifted, the disadvantage that airtightness of the cooling flow path R is not ensured or sufficient pressure resistance cannot be obtained or the like occurs. Thus, to prevent the shift of the flat plates 1 and 2, one of the flat plates is provided with a claw. And when the one flat plate is laminated with the other flat plate, this claw is closed to fix both flat plates. However, this shift prevention countermeasure has the problems that a step of closing the claw is needed thereby increasing the assembly time and excess material for the claw is needed whereby the production costs are increased when it is assumed mass production is used.

The present invention was made in consideration of the above-mentioned circumstances. It is an object of the present invention to reduce the pressure loss which acts on a cooling medium flow path in accordance with the change of dryness of the cooling medium thereby to enhance the heat exchange performance in a drawn cup type heat exchanger.

It is another object of the present invention to uniformly distribute a cooling medium to a cooling medium flow path and at the same time reduce the pressure loss in the cooling medium flow path thereby to enhance the heat exchange performance.

It is still another object of the present invention to review a shift prevention structure provided in two flat plates constituting a cooling medium flow portion thereby to reduce the assembly time and the production costs.

SUMMARY OF THE INVENTION

The present invention relates to a heat exchanger in which a plate-shaped cooling medium flow portion provides an internal cooling medium flow path by laminating two flat plates subjected to drawing and a cooling fin are alternately laminated, a cooling medium inlet for allowing a cooling medium to flow into the cooling medium flow path and a cooling medium outlet for allowing a cooling medium which has passed through the cooling medium flow path to flow out are formed in the two flat plates, and the cooling medium flowing from the cooling medium inlet to the cooling medium flow portion is passed through the cooling medium flow path and is then allowed to flow out of the cooling medium outlet.

Particularly, the heat exchanger of the present invention is characterized in that a bulged portion protruding on the cooling medium flow path side is formed in the cooling medium flow portion by denting at least any one of the two flat plates from the outside, and a plurality of elliptical or oval cylindrical portions whose major diameter is oriented in the flow direction of the cooling medium are provided between two flat plates by butting the top portion of the bulged portion to the opposite flat plate, and the arrangement number of the plurality of cylindrical portions is gradually decreased as the cooling medium flows toward the downstream side in the flow direction of the cooling medium.

Further, another heat exchanger of the present invention is characterized in that a bulged portion protruding on the cooling medium flow path side is formed in the cooling medium flow portion by denting at least any one of the two flat plates from the outside, a plurality of elliptical or oval cylindrical portions whose major diameter is oriented in the flow direction of the cooling medium are provided between two flat plates by butting the top portion of the bulged portion to the opposite flat plate, and this plurality of cylindrical portions is formed of shapes gradually decreasing in size as the cooling medium flows toward the downstream side in the flow direction of the cooling medium.

In this case, it is preferable that the cylindrical portions diagonally adjacent to each other with respect to the flow direction of the cooling medium are arranged so that the cylindrical portions partially overlap along the flow direction.

Further, another heat exchanger of the present invention is characterized in that the cooling flow path is formed in a U-shape and runs in one direction from a cooling medium inlet and returns to pass through a cooling medium outlet, and that the cross-section of the cooling medium flow path corresponding to the return path is formed so as to be larger than the cross-section of the cooling medium flow path corresponding to the forward path.

Further, another heat exchanger of the present invention is characterized in that the cooling medium outlet is formed so as to be larger than the cooling medium inlet. In this case a plurality of the cooling outlets are provided and the total opening area of each cooling medium outlet may be larger than the opening area of the cooling medium inlet.

Further, the present invention also relates to a heat exchanger in which a plate-shaped cooling medium flow portion provides an internal cooling medium flow path by laminating two flat plates subjected to drawing and a cooling fin are alternately laminated, an opening portion for allowing a cooling medium to flow into the cooling medium flow path is formed in two flat plates respectively, and a continuous space is formed in laminated adjacent cooling medium flow portion by butting adjacent opening portions so that the cooling medium flowing within this space is allowed to flow from the opening portion to the cooling medium flow path to thereby be distributed into each cooling medium flow portion.

Particularly, the heat exchanger of the present invention is characterized in that a restricting portion for restricting the flow of the cooling medium to guide a part of the cooling medium into the opening portion is provided in this space. In this case for example a protrusion which protrudes toward the upstream side in a flow direction of the cooling medium is formed as the restricting portion. Further, it is preferable that the restricting portion is provided integrally with any one of the two flat plates. Further, it is also preferable that the restricting portion is formed by being subjected to barring around the opening portion.

Further, another heat exchanger of the present invention is characterized in that a flow path cross-section of the cooling medium flow path communicating with the space on the inlet side (inlet side space) of the cooling medium is gradually reduced as the cooling flows toward the downstream side in the flow direction of the cooling medium.

Further, another heat exchanger of the present invention is characterized in that a flow path cross-section of the cooling medium flow path communicating with the space on the outlet side (outlet side space) of the cooling medium is gradually magnified as the cooling medium flows toward the downstream side in the flow direction of the cooling medium.

Further, the present invention is characterized in that in a heat exchanger wherein a cooling medium allowed to flow into a cooling medium inlet through the above-mentioned space on the inlet side and distributed to each cooling medium flow portion is passed through a cooling flow path and is allowed to flow out of a cooling medium outlet thereby to be discharged through the above-mentioned space on the outlet side, a baffle plate having an opening for allowing the cooling medium to pass and guiding the cooling medium, which cannot be passed through this opening portion, to the cooling medium flow path is respectively provided in the cooling medium inlet of each cooling medium flow portion and opening portions provided in the adjacent baffle plates are arranged so as not to overlap in the flow direction of the cooling medium. Alternatively, a baffle plate positioned on further downstream in the flow direction of the cooling medium may have the opening formed in a smaller size.

Further, another heat exchanger of the present invention is characterized in that as a register portion for registering the above-mentioned two flat plates, a protrusion portion formed in any one of the two flat plates and a concave portion formed in the other of the two flat plates so that the concave portion is fitted to the protrusion portion in a state of lamination of the two flat plates, are provided. In this case it is preferable that the register portions are provided at least two or more positions. Further, the protrusion portion and the concave portion are more preferably formed by concave and convex portions formed in the two flat plates when they are subjected to drawing. Alternatively, as the register portion a protrusion portion formed in any one of the two flat plates and a hole formed in the other of the two flat plates so that the concave portion is fitted to the protrusion portion in a state of lamination of the two flat plates, can be provided.

DESCRIPTION OF PREFERRED EMBODIMENTS

EXAMPLE 1

The first example of a heat exchanger according to the present invention will be described with reference to FIGS. 1 to 6.

Figure 1:
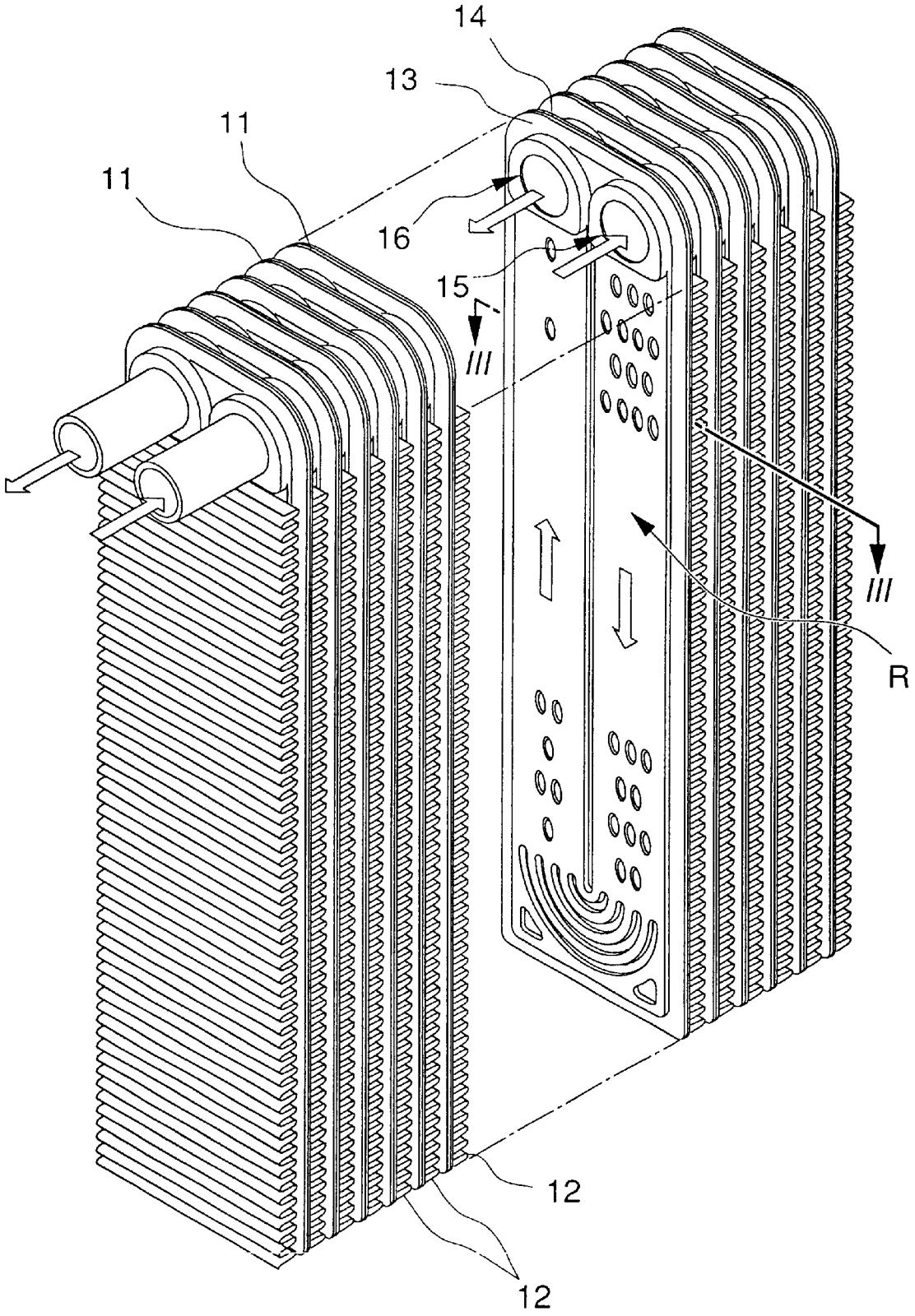
FIG. 1 is a perspective view showing the first example of a heat exchanger according to the present invention.

The heat exchanger shown in FIG. 1 is configured so that a plate-shaped cooling medium flow portion 11 and a wave-shaped cooling fin 12 are alternately laminated.

Figure 2:
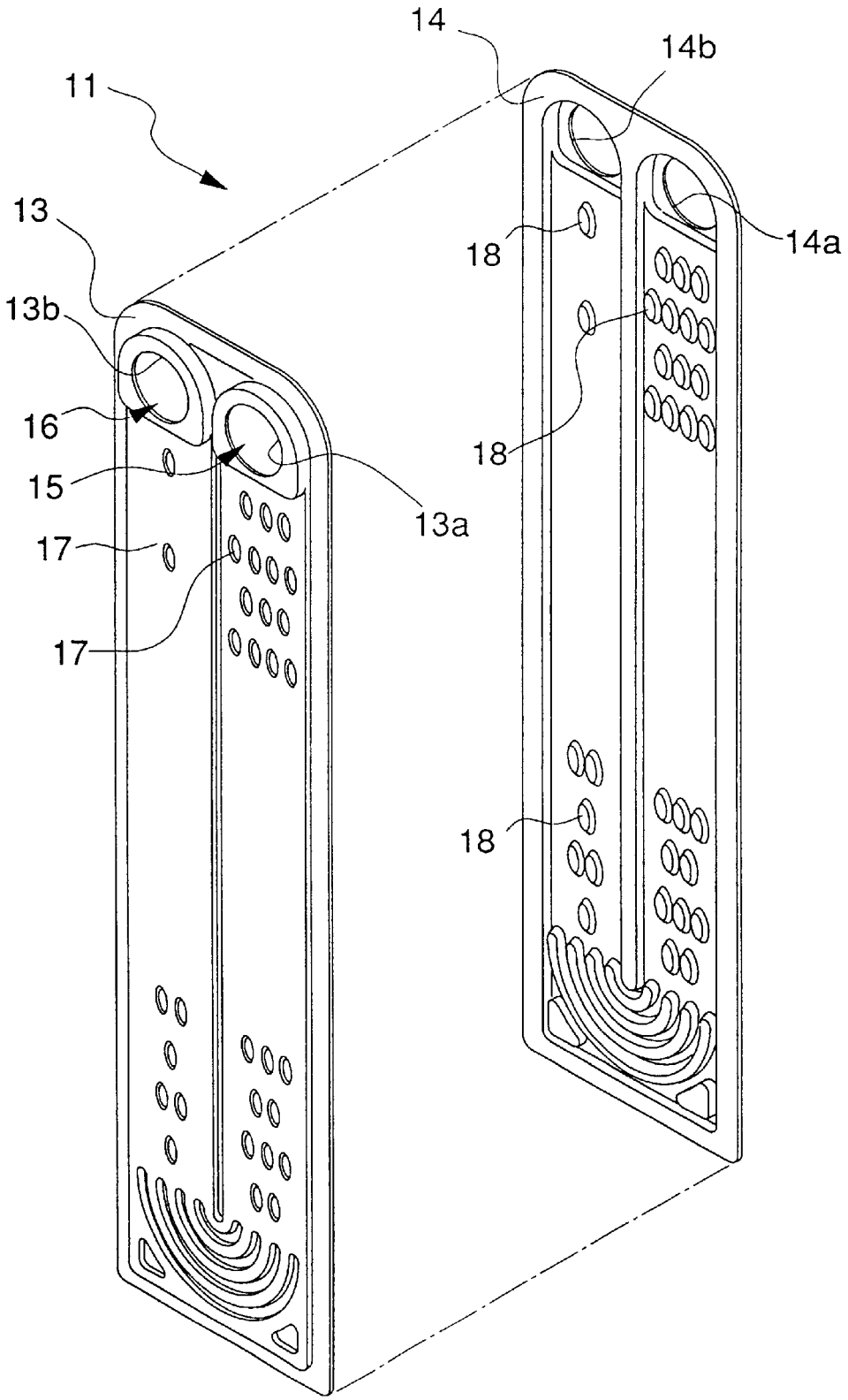
FIG. 2 is an exploded perspective view showing a cooling medium flow path which constitutes the heat exchanger of FIG. 1.

The cooling medium flow portion 11 is formed by laminating substantially rectangular flat panels 13 and 14 which have been subjected to drawing as shown in FIG. 2 and brazing their outer peripheral portions and their central portions. The upper portion of the cooling medium flow portion 11 is provided with a cooling medium inlet 15 and a cooling medium outlet 16 in parallel. As the result of brazing the outer peripheral portions and the central portions of the flat plates 13 and 14, a U-shaped type cooling medium flow path R which runs downward from a cooling medium inlet 15 and returns back at the lower end portion to pass through a cooling medium outlet 16 is formed within the cooling medium flow portion 11.

Figure 3:
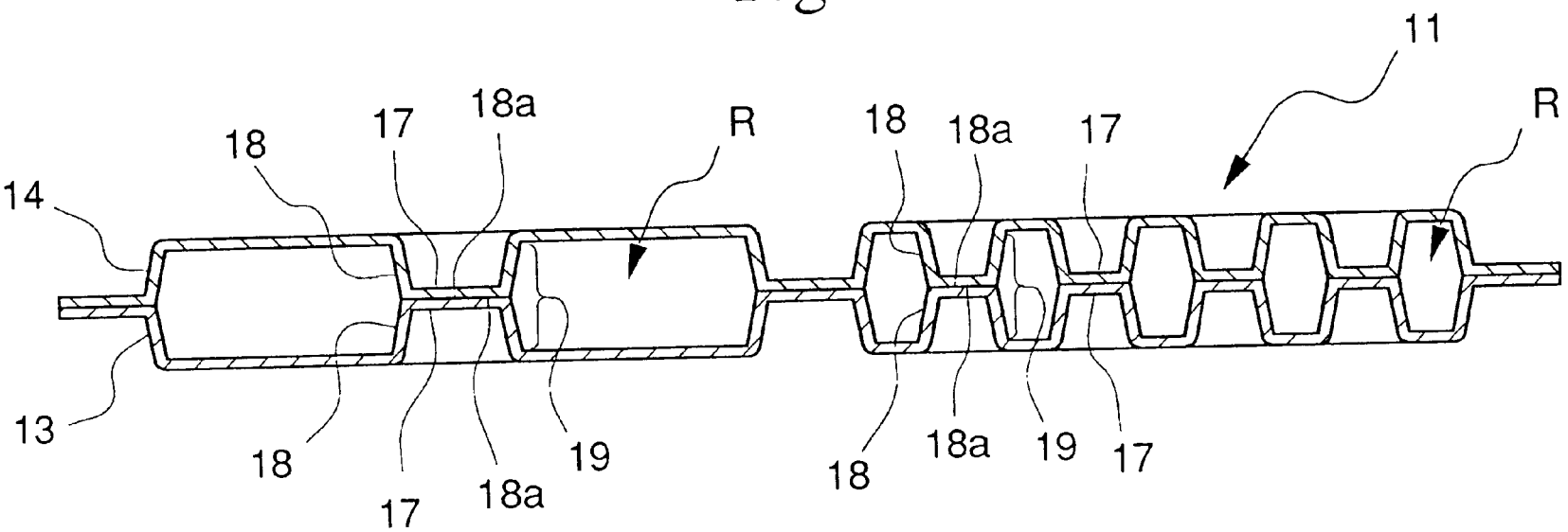
FIG. 3 is a cross-sectional view taken along the line III—III in FIG. 1.

In the cooling medium flow portion 11 is formed a plurality of dimples 17 by denting the flat plates 13 and 14 which form the cooling medium flow path R from the outside, and these dimples 17 form a plurality of bulged portions (protrusions) 18 in the cooling medium flow path R. Each of these bulged portions 18 has an elliptic shape which defines the flow W direction of the cooling medium as the major diameter when viewed in a plane view as shown in FIG. 3. By brazing opposed top portions 18*a* of the bulged portions 18 an elliptic cross-sectioned cylindrical portion 19 is formed between the flat plates 13 and 14. The shape of the cylindrical portion 19 is not limited to an ellipse but it may be an oval.

Figure 4:
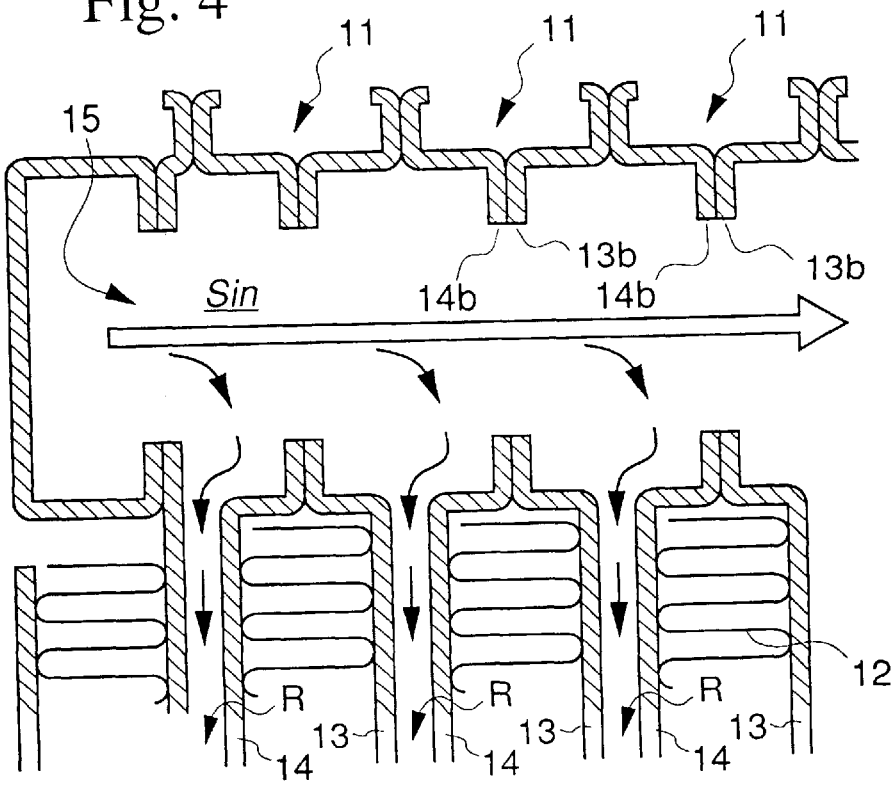
FIG. 4 is a cross-sectional view showing the space on the inlet side and a cooling medium flow path connected to the space in the first example of the heat exchanger according to the present invention.
Figure 5:
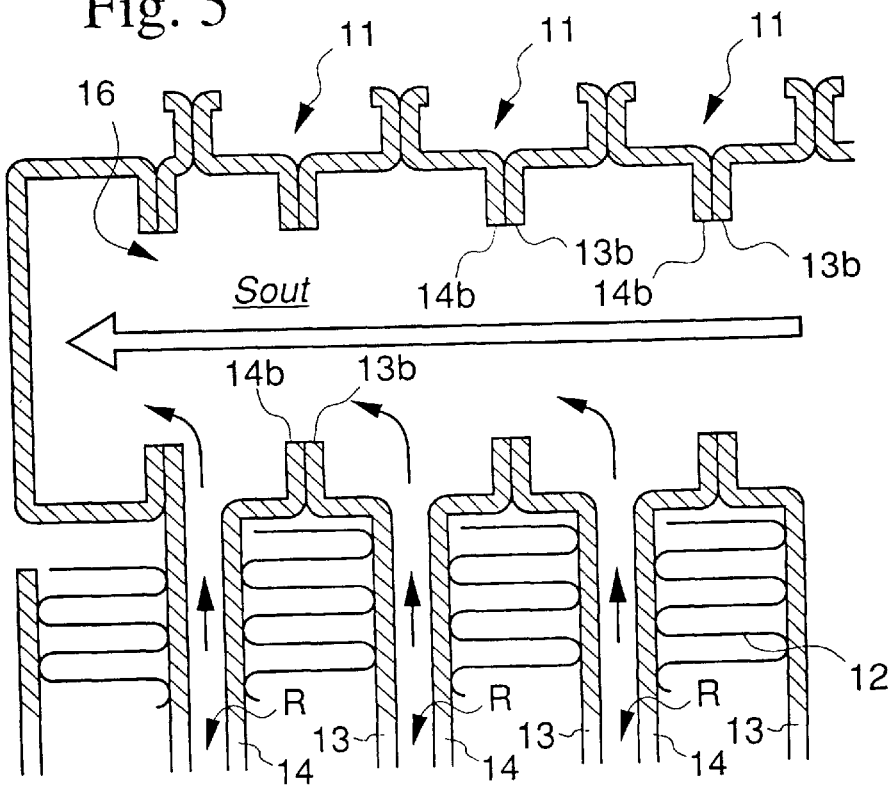
FIG. 5 a cross-sectional view showing the space on the outlet side and a cooling medium flow path connected to the space in the first example of the heat exchanger according to the present invention.

The cooling medium inlet 15 is composed of opening portions 13*a* and 14*a* formed in the flat plates 13 and 14, respectively. The cooling medium inlets 15 provided in each cooling medium flow portion 11 are butted to each other without sandwiching the cooling fin 12 as shown in FIG. 4 so that continuous space Sin on the inlet side is formed. The cooling medium inlet 15 is composed of opening portions 13*a* and 14*a* formed in the flat plates 13 and 14, respectively. Also, the cooling medium inlet 16 is composed of opening portions 13*b* and 14*b* formed in the flat plates 13 and 14, respectively. The cooling medium inlets 16 provided in each cooling medium flow portion 11 are butted to each other without sandwiching the cooling fin 12 as shown in FIG. 5 so that continuous space Sout on the outlet side is formed.

In the above-mentioned structured heat exchanger the cooling medium is distributed into each of the cooling medium flow portions 11 in the process of running through the space Sin on the inlet side in the direction of the arrow in the FIG. 4, and the distributed cooling medium is vaporized in the process of passing through the cooling medium flow path R, and the cooling is collected again in the space Sout on the outlet side thereby to flow out. While the cooling medium is flows through the cooling medium flow path R the cooling medium collides as a result against the cylindrical portion 19 provided in the cooling medium flow path R, whereby turbulence occurs in the flow of the cooling medium and the thermal conductivity is enhanced by the turbulence effect.

Figure 6:
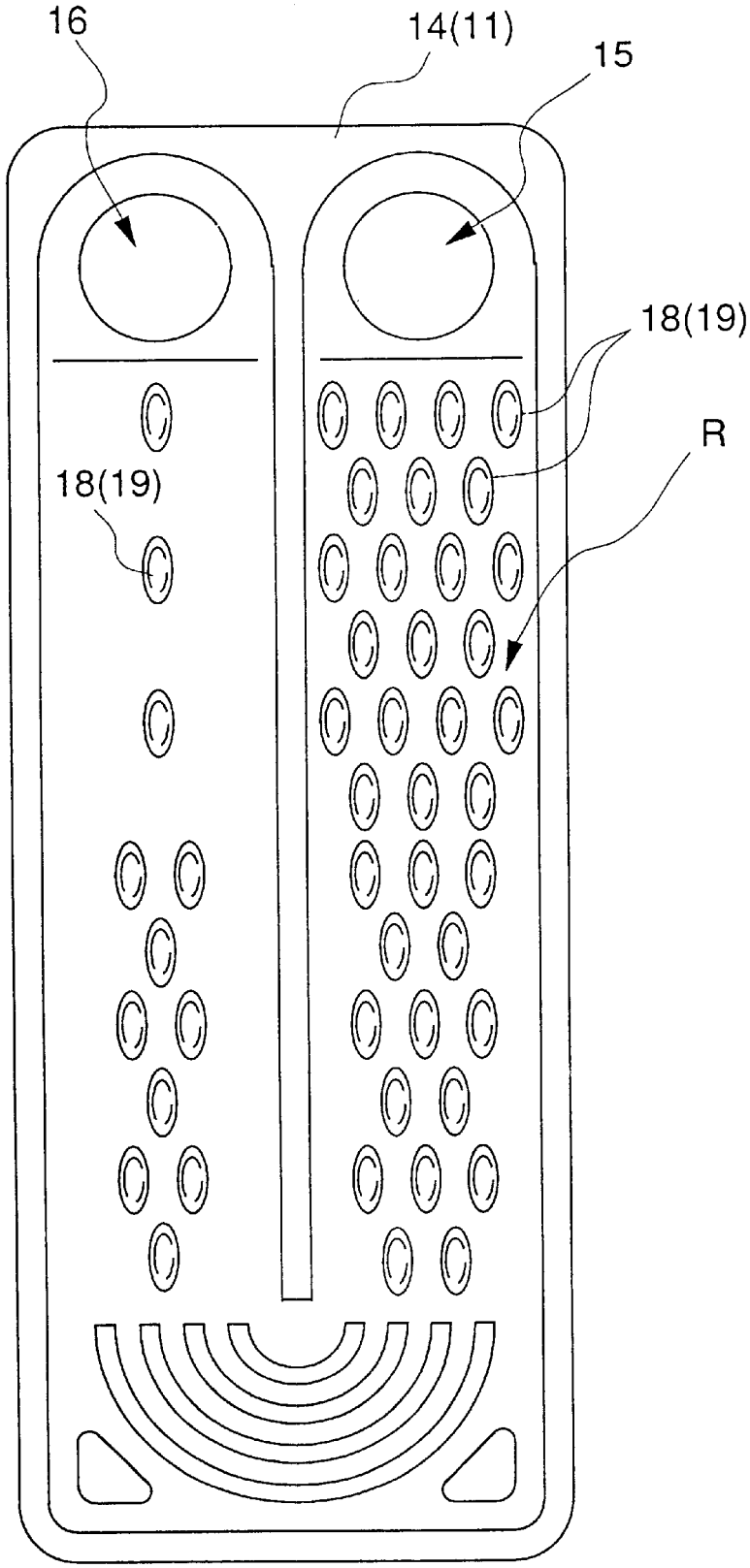
FIG. 6 an exploded view for explaining a shape of the cooling medium flow path in the first example of the heat exchanger according to the present invention.

Further, in the case of the heat exchanger of the present example, the bulged portions 18 are provided in such a manner that they gradually become fewer as the cooling medium flows downstream in the flow direction of the cooling medium in the cooling medium flow path R, as shown in FIG. 6. Accordingly, the cylindrical portions 19 are provided in such a manner that they gradually become fewer (the number of the cylindrical portions 19 is gradually reduced) as the cooling medium flows downstream. Thus, the cross-sectional area of the cooling medium flow path R is increased as the cooling medium flows downstream.

In a heat exchanger used as an evaporator the dryness of a cooling medium is gradually increased (the gas phase is further increases in proportion to the liquid phase) as the cooling medium flows downstream in the cooling medium flow path R. Accordingly, the specific volume of the cooling medium and the flow path resistance are gradually increase as the cooling medium flows downstream. On the other hand, in the present example by gradually decreasing the number of cylindrical portions 19 thereby to gradually increase the cross-sectional area of the cooling medium flow path R in accordance with the increase in the specific volume of the cooling medium along the flow direction, the flow path resistance of the cooling medium is decreased as the cooling medium flows downstream. As the result, the thermal conductivities are kept at higher values over the entire area of the cooling medium flow path R and pressure losses are kept at lower values. Therefore, the heat exchangeability when used as an evaporator of a heat exchanger is enhanced.

EXAMPLE 2

The second example of a heat exchanger according to the present invention will be described with reference to FIG. 7. In the following each example, the same reference numerals are used for the components already described in the above-described first example and the descriptions thereof are omitted.

Figure 7:
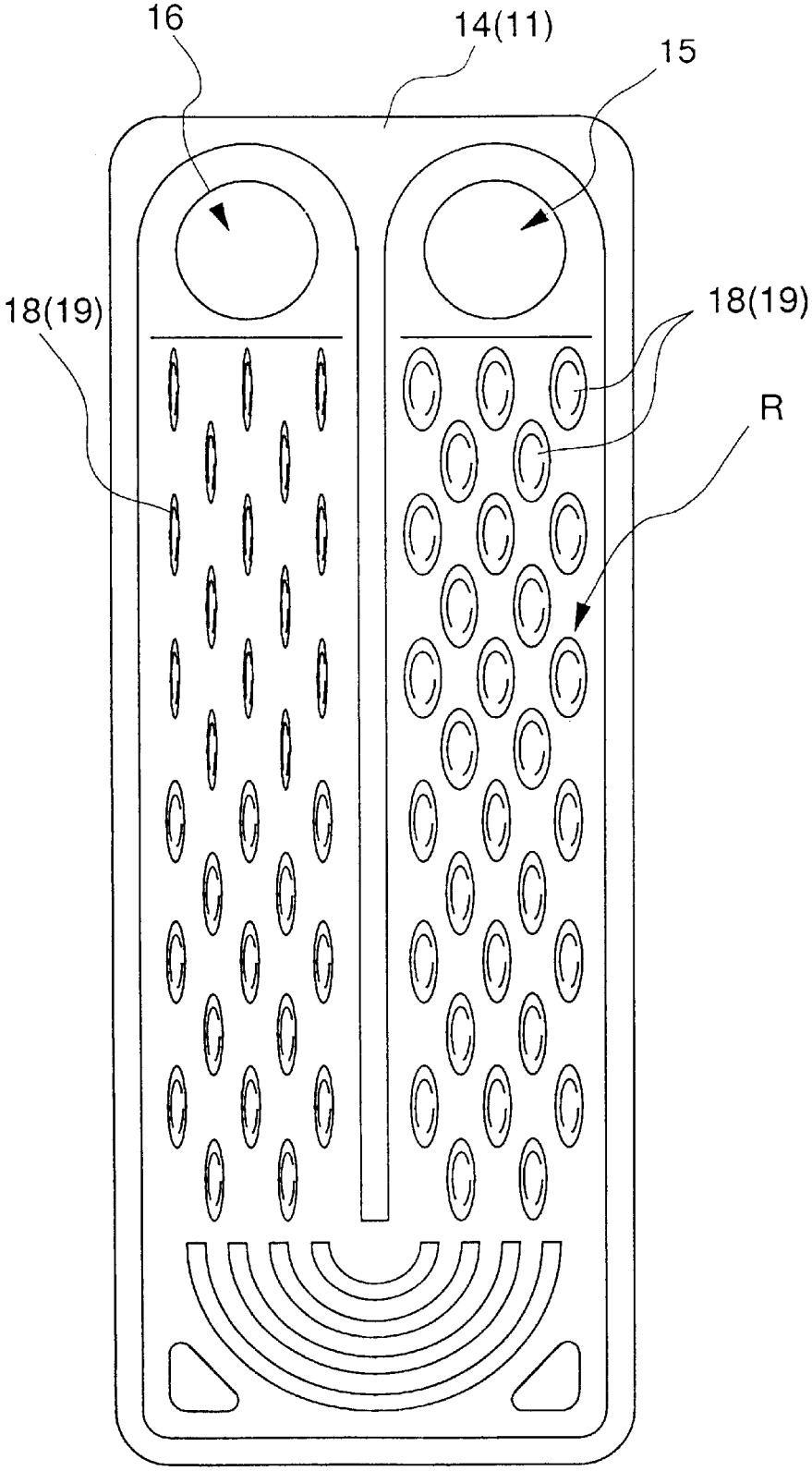
FIG. 7 is a view showing the second example of a heat exchanger according to the present invention, specifically an exploded view for explaining the shape of the cooling medium flow path thereof.

In this heat exchanger the bulged portions 18 are formed in such a manner that they gradually become smaller as the cooling medium flows downstream in the flow direction of the cooling medium as shown in FIG. 7. Accordingly, the cylindrical portions 19 are also formed in such a manner that they gradually become smaller as the cooling medium flows downstream. Thus, the cross-sectional area of the cooling medium flow path R is increased as the cooling medium flows downstream.

Further, in this example the bulged portions, which are diagonally adjacent to each other with respect to the flow direction of the cooling medium are arranged in zigzag pattern so that they partly overlap along the flow direction of the cooling medium. Accordingly, the respective cylindrical portions 19 are arranged zigzag.

In this heat exchanger, by forming the cylindrical portions 19 which become gradually smaller thereby to gradually increase the cross-sectional area of the cooling medium flow path R in accordance with increase in the specific volume of the cooling medium which flows upstream to downstream, the flow path resistance of the cooling medium is decreased as the cooling medium flows downstream. As the result, the thermal conductivities are kept at higher values over the entire area of the cooling medium flow path R and pressure losses are kept at lower values. Therefore, the heat exchangeability when used as an evaporator of a heat exchanger is enhanced.

Further, in the cylindrical portions 19, which are diagonally adjacent to each other with respect to the flow direction of the cooling medium, the front end portion of a cylindrical portion 19 which is positioned downstream of the rear end portion of an upstream cylindrical portion, becomes the upstream side of the flow direction. Accordingly, the local thermal conductivity, which tends to be reduced at the rear end portion of a cylindrical portion 19 which is positioned upstream is compensated by the cylindrical portion 19 which is positioned downstream. As the result, the thermal conductivity of the entire cooling medium flow portion 11 is enhanced.

Additionally, the cylindrical portions 19 are regularly arranged along the flow direction of the cooling medium, and an extent of a joint portion which is positioned at the top portions 18*a* can be generally ensured. Thus, in any cross-section of the cooling flow portion 11 in the flow direction of the cooling medium, two flat plates 13 and 14 are joined to each other by adhesion of the bulged portions 18 whereby the joint strength of the cooling medium flow portion can be enhanced. Therefore, even if the flat plates 13 and 14 are thin, a sufficient pressure resistance is imparted to the cooling flow portion 11.

EXAMPLE 3

Figure 8:
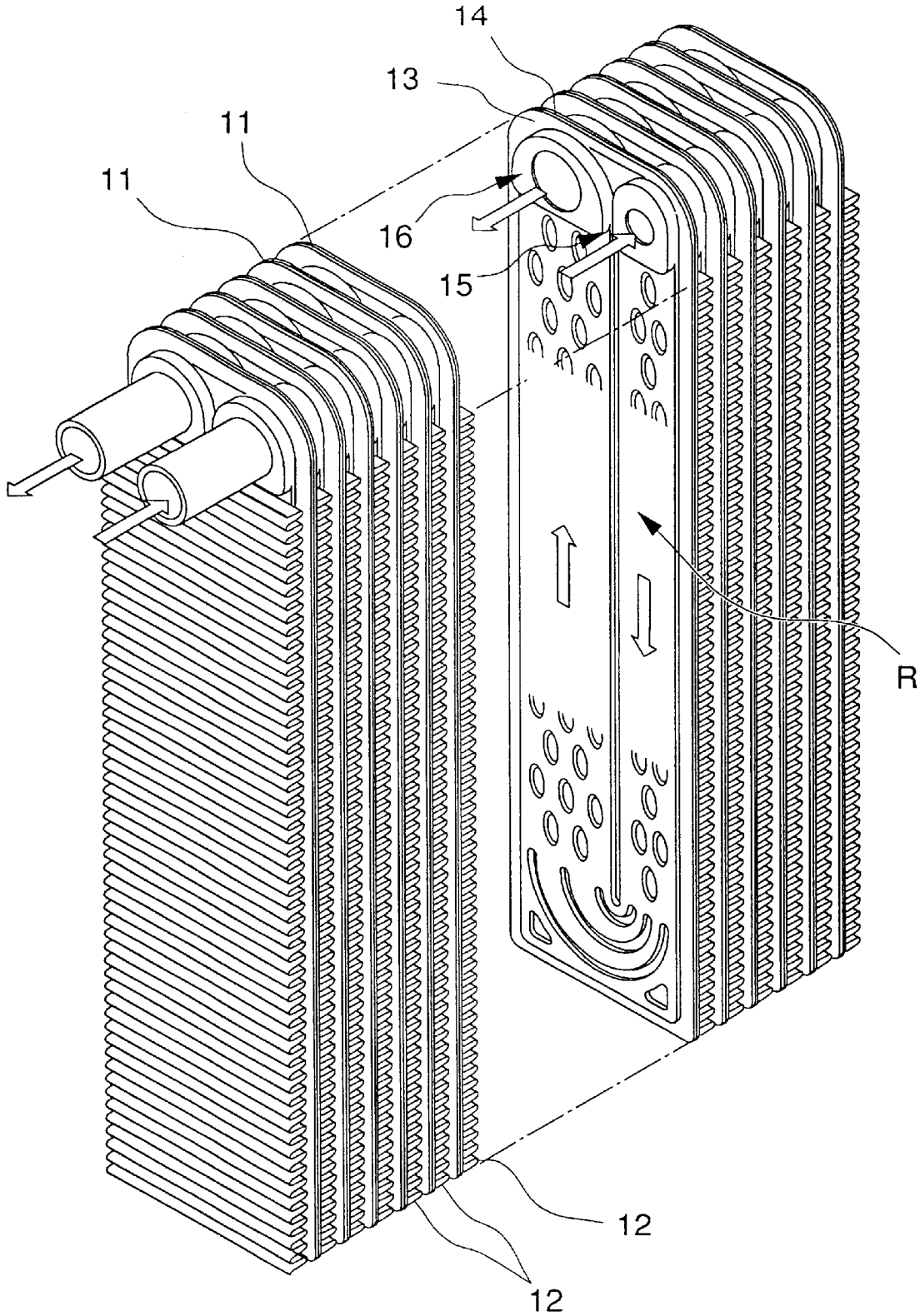
FIG. 8 is a perspective view showing the third example of the heat exchanger according to the present invention.
Figure 9:
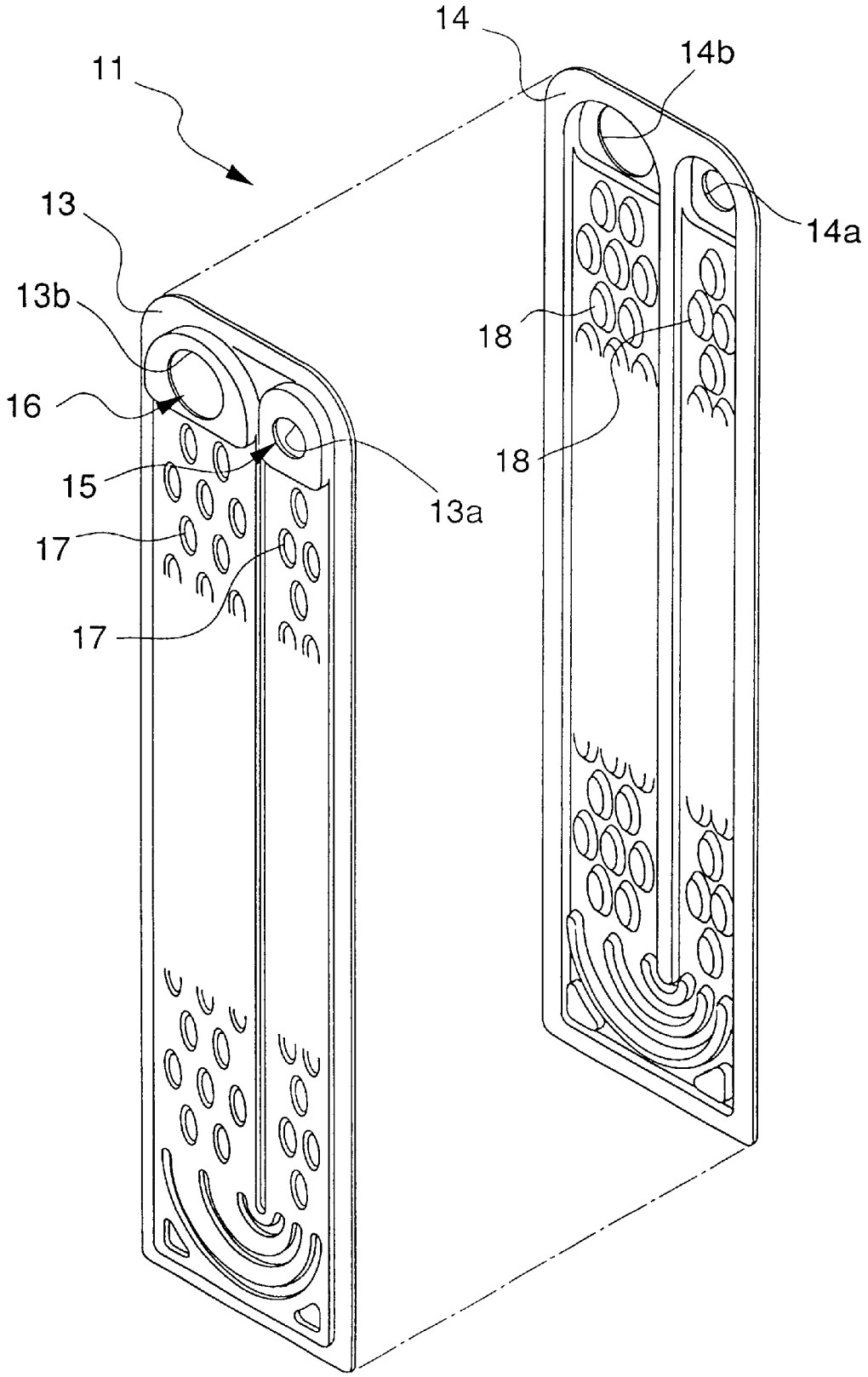
FIG. 9 is an exploded perspective view showing the cooling medium flow path which constitutes the heat exchanger of FIG. 8.
Figure 10:
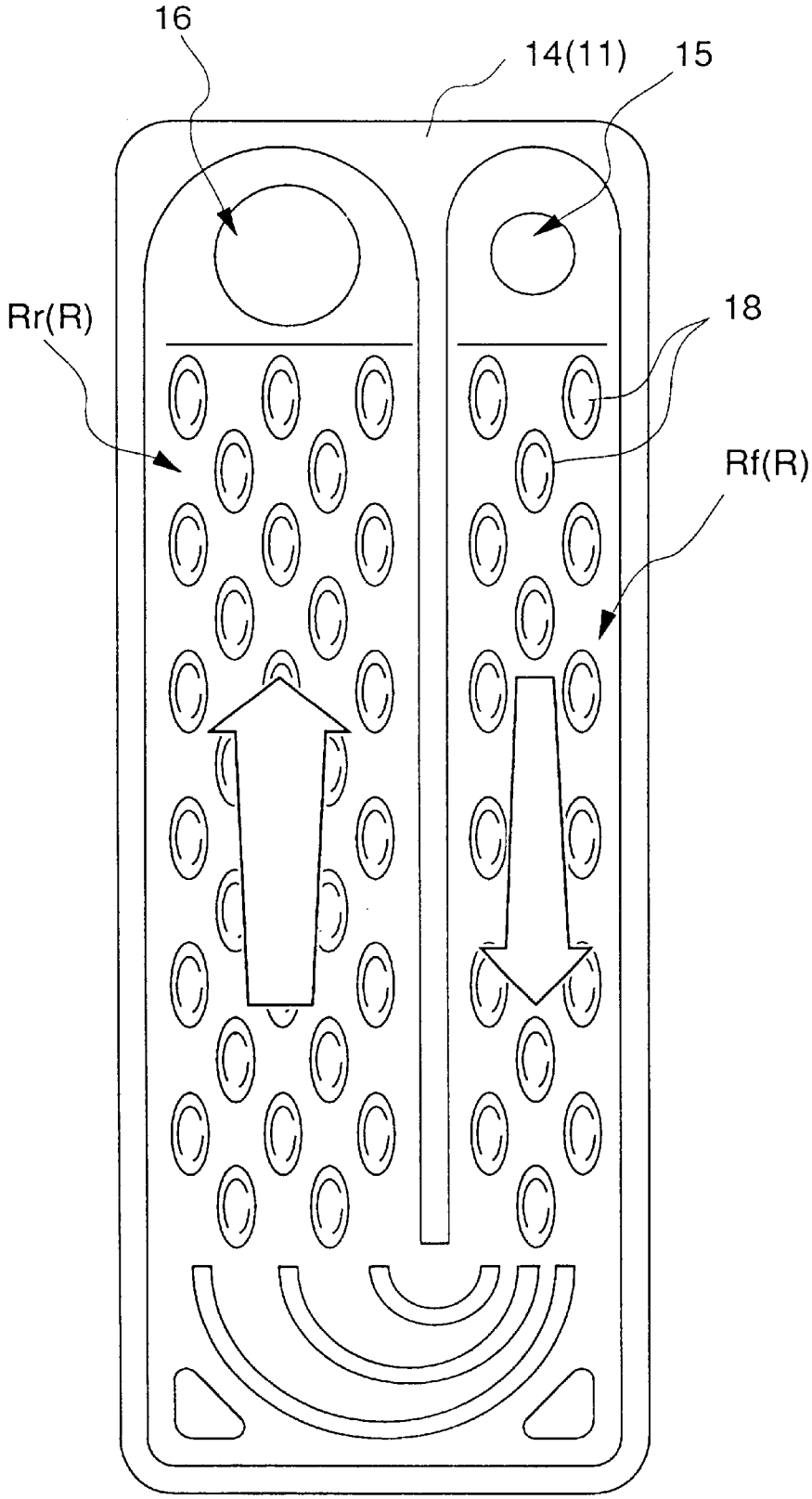
FIG. 10 is an exploded view for explaining the shape of the cooling medium flow path in the third example of the heat exchanger according to the present invention.

The third example of a heat exchanger according to the present invention will be described with reference to FIGS. 8 to 10. In the heat exchanger of the present example, by forming brazed portions positioned at the central portions of the flat plates 13 and 14 in positions biased to the forward path side as shown in FIGS. 8 to 10, the flow path cross-section of the cooling flow path R corresponding to the backward path can be made larger than the flow path cross-section of the cooling flow path R corresponding to the forward path.

In this heat exchanger, by making the flow path cross-section of the cooling flow path Rf corresponding to the backward (return) path larger than the flow path cross-section of the cooling flow path Rf corresponding to the forward path in accordance with the increase in the specific volume of the cooling medium which flows from the upstream toward the downstream, the flow path resistance of the cooling medium is decreased and the thermal conductivities are kept at higher values over the entire area of the cooling medium flow path R and also pressure losses are kept at lower values. Therefore, the heat exchangeability when used as an evaporator of a heat exchanger is enhanced.

Incidentally, in the present example the sizes of the flow path cross-sections of the cooling flow paths R were differentiated between the forward path and the backward path by biasing the positions of brazed portions positioned at the central portions of the flat plates 13 and 14. However, a difference may be imparted to the flow path cross-sections between the forward path and the backward path by changing the size of the dimple.

EXAMPLE 4

Figure 11:
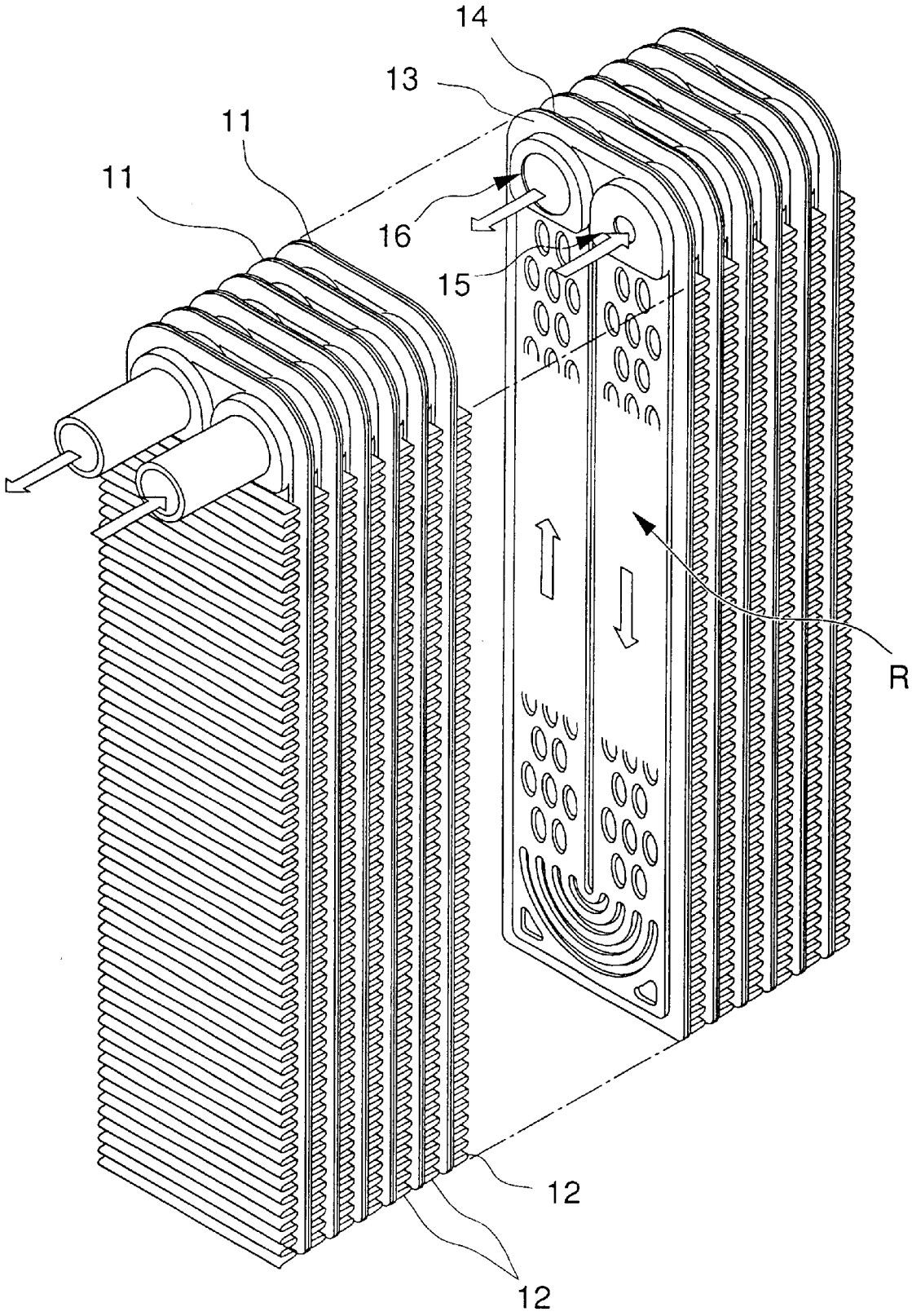
FIG. 11 is a perspective view showing the fourth example of a heat exchanger according to the present invention.
Figure 12:
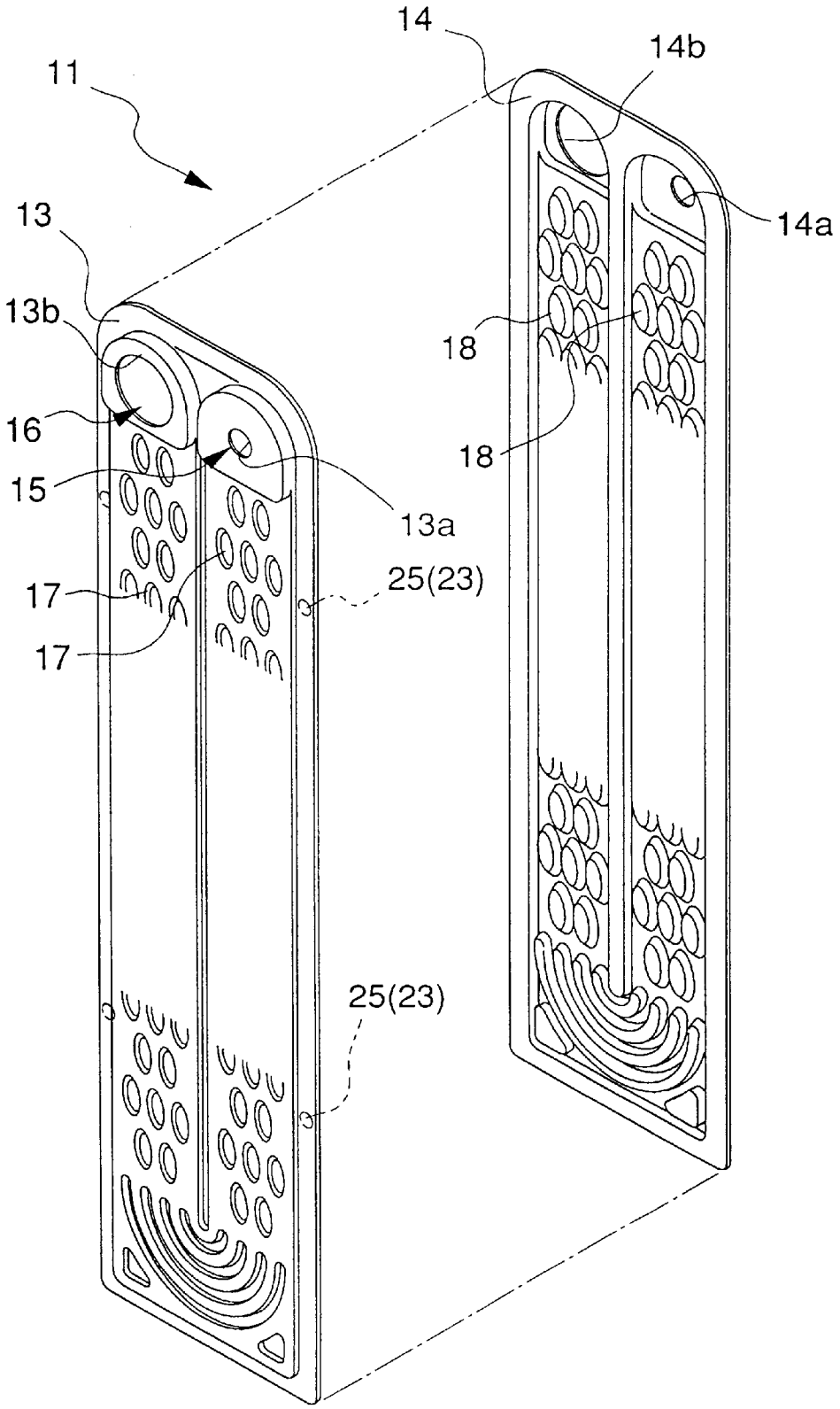
FIG. 12 is an exploded perspective view showing a cooling medium flow path which constitutes the heat exchanger of FIG. 11.
Figure 13:
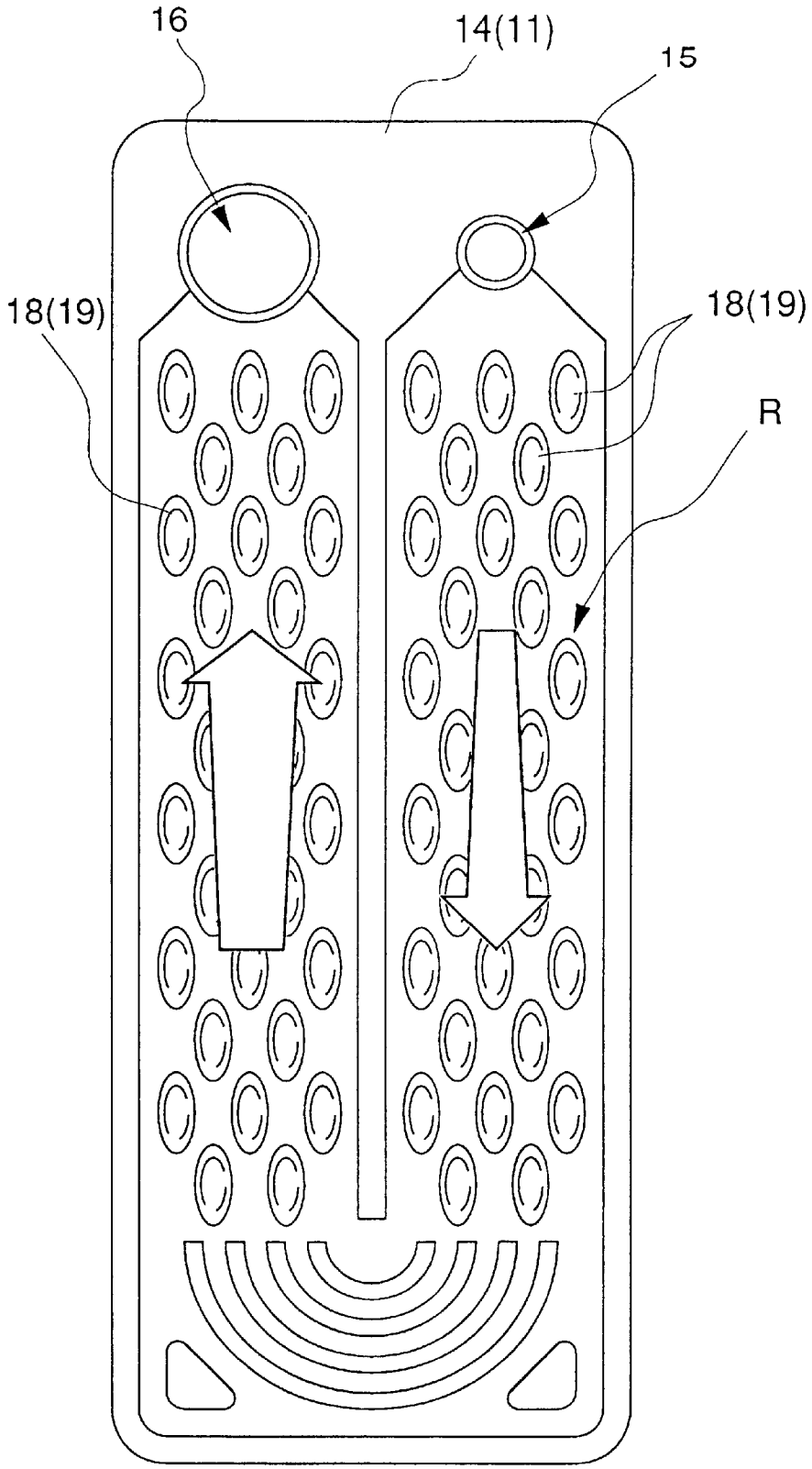
FIG. 13 is a cross-sectional view showing the space on the inlet side and a cooling medium flow path connected to the space in the fourth example of the heat exchanger according to the present invention.

The fourth example of a heat exchanger according to the present invention will be described with reference to FIGS. 11 to 13. In the heat exchanger of the present example, the cooling medium outlet 16 is formed with a larger size than the cooling medium inlet 15 as shown in FIGS. 11 to 13.

In this heat exchanger, by forming the cooling medium outlet 16 in a larger size than the cooling medium inlet 15 in accordance with an increase in the specific volume of the cooling medium which flows from the upstream toward the downstream, flow path resistance of the cooling medium in the vicinity of the cooling medium outlet 16 is decreased. Thus, thermal conductivities are kept at higher values over the entire area of the cooling medium flow path R and also pressure losses are kept at lower values. Therefore, the heat exchangeability when used as an evaporator of a heat exchanger is enhanced.

Incidentally, in the present example a heat exchanger in which one space Sin on the inlet side and one space Sout on the outlet side are provided was described. However, by providing one space Sin on the inlet side and two spaces Sout on the outlet side the total opening areas of the two cooling medium outlets 16 may become larger than the opening area of the cooling medium inlet 15.

EXAMPLE 5

Figure 14:
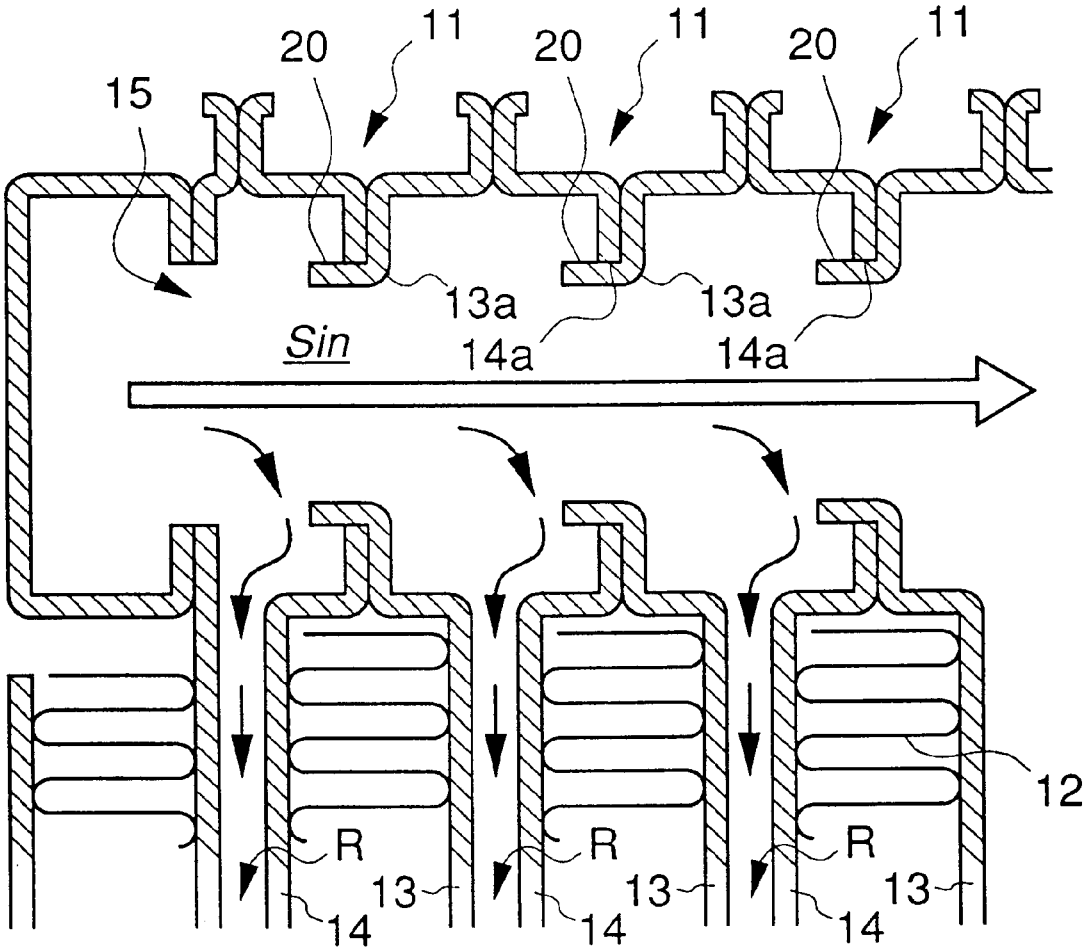
FIG. 14 is a cross-sectional view showing the space on the inlet side and a cooling medium flow path connected to the space in the fifth example of the heat exchanger according to the present invention.

The fifth example of a heat exchanger according to the present invention will be described with reference to FIGS. 14 to 16. In the heat exchanger of the present example, protrusions (restricting portions) 20 which restrict the flow of a flowing cooling medium and lead a part of the cooling medium to a cooling medium inlet 15 composed of openings 13*a* and 14*a* are provided in an inlet side space Sin formed on the cooling medium inlet 15 side, as shown in FIG. 14. The protrusion 20 is integrally provided with the flat plate 13 by carrying out barring around the opening 13*a* and protrudes on the upstream side of the flow direction of the cooling medium so that it is fitted to the opening 14*a* of the adjacent cooling medium flow portion 11.

When the protrusion 20 which restricts the flow of the cooling medium is formed in the inlet side space Sin, a flow of a part of the cooling medium which flows in the inlet side space Sin is restricted so that it is obstructed with the protrusion 20, and the cooling medium is introduced from the cooling medium inlet 15 to the cooling medium flow path R. Thus, relatively much cooling medium is distributed to the cooling medium flow portion 11 positioned on the upstream side of the cooling medium flow portion 11 where a cooling medium was apt to remain. As the result, a uniform heat exchange can be carried out in all of the plurality of cooling flow portions and the heat exchangeability of the heat exchanger is enhanced.

Further, since the protrusion 20 can be easily formed by barring the periphery of the opening portion 13*a* during drawing of the flat plate 13, there are almost no increases in the production processes or cost which for formation of the protrusion 20.

The degree of restriction of the cooling by the protrusion 20 can be appropriately set by varying the size of the protrusion 20 and adjusting the orientation of the protrusion 20 during drawing of the flat plate 13, whereby the cooling medium can be distributed uniformly.

Incidentally, in the present example the protrusion 20 was provided on the flat plate 13. However, it can be provided on the flat plate 14. Alternatively, the protrusion 20 may be formed with another member and brazed at the same time when the flat plates 13 and 14 are brazed.

Figure 15:
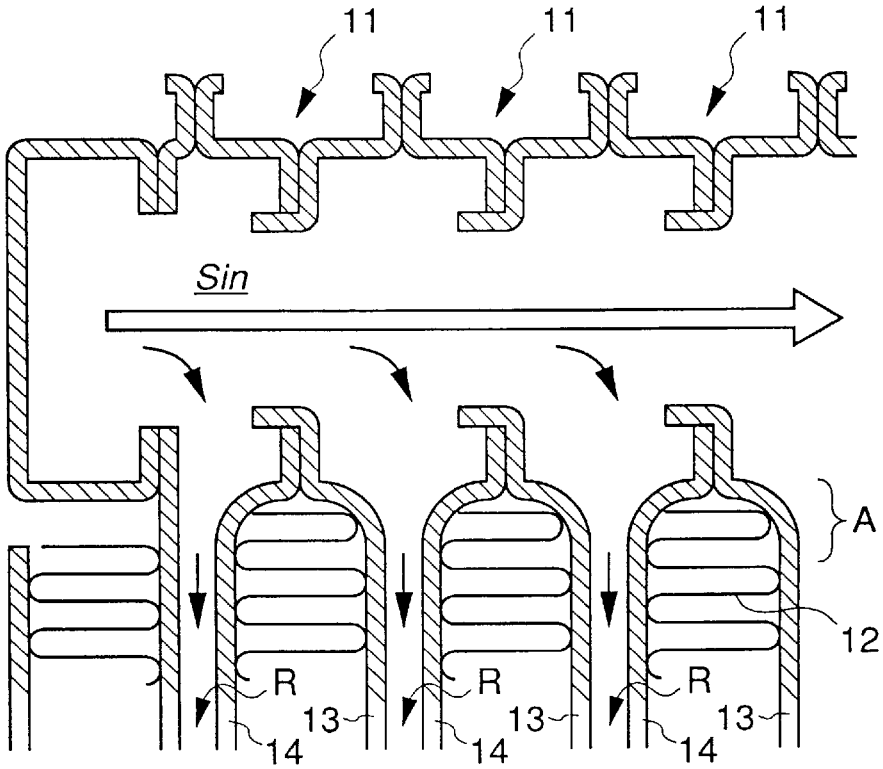
FIG. 15 is a cross-sectional view showing the space on the inlet side and a cooling medium flow path connected to the space, that is a modified example of the fifth example the. heat exchanger according to the present invention.
Figure 16:
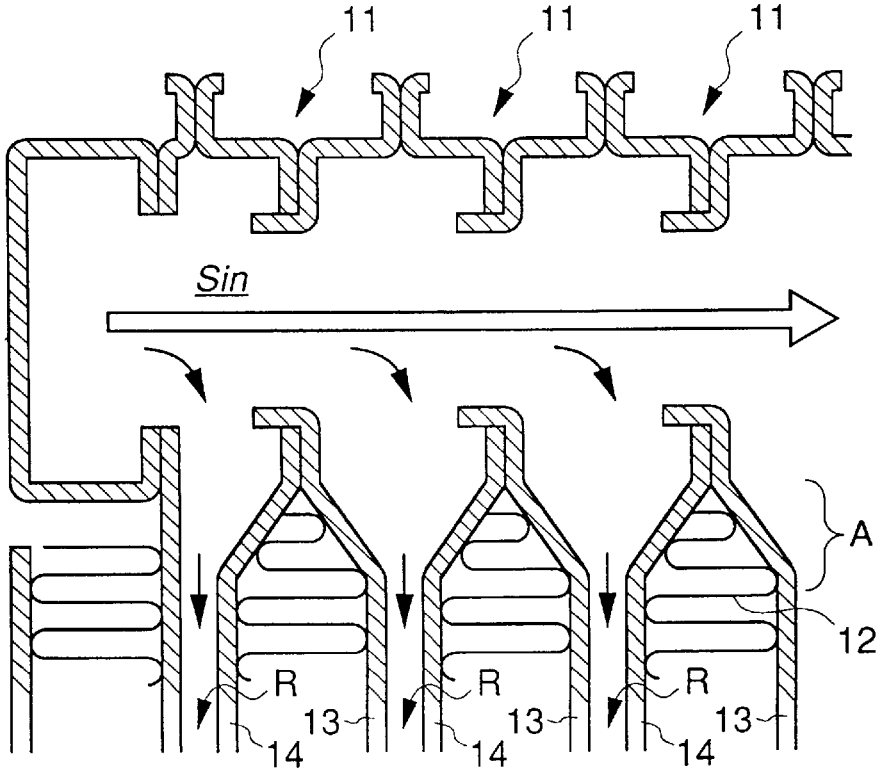
FIG. 16 is a cross-sectional view showing the space on the inlet side and a cooling medium flow path connected to the space, that is a modified example of the fifth example the heat exchanger according to the present invention.

Alternatively, for example, as shown in FIGS. 15 and 16, the cooling medium flow path R communicating with the space Sin on the inlet may be deformed so that the flow path cross-section of it is gradually reduced toward the downstream side of the flow direction of the cooling medium at an inlet portion where the cooling medium flows from the space Sin on the inlet side to the cooling medium flow path R (corresponding to portion A in FIGS. 15 and 16). In this case, although the outlet portion is not shown, the region where the cooling medium flows from the cooling medium flow path R to the space Sout on the outlet, is also deformed so as to gradually increase as the cooling medium flows downstream in the flow direction. These deformations are made when the flat plates 13 and 14 are subjected to drawing.

By gradually reducing the flow path cross-section of the cooling medium flow path R communicating with the space Sin on the inlet side as the cooling medium flows downstream in the flow direction of the cooling medium, the rapid reduction of the cooling medium flow path R is decreased, whereby the pressure loss of the cooling medium which flows from the space Sin on the inlet side to the cooling medium flow path R is decreased. Similarly, by gradually magnifying the flow path cross-section of the cooling medium flow path R communicating with the space Sout on the outlet side as the cooling medium flows downstream in the flow direction of the cooling medium, the rapid increase of the cooling medium flow path R is decreased whereby the pressure loss of the cooling medium which flows from the cooling medium flow path R to the space Sout on the outlet side is decreased. As the results, the pressure losses at the inlet and outlet of the cooling medium flow path R are decreased and the heat exchangeability of the heat exchanger is enhanced.

In this example as shown in FIG. 15 a shape of the wall surface of the cooling medium flow path R is curved. However, the wall surface shape of that portion is not limited to a curved shape. For example, as shown in FIG. 16 the shape of the wall surface of the cooling medium flow path R may be wedge-shaped.

EXAMPLE 6

Figure 17:
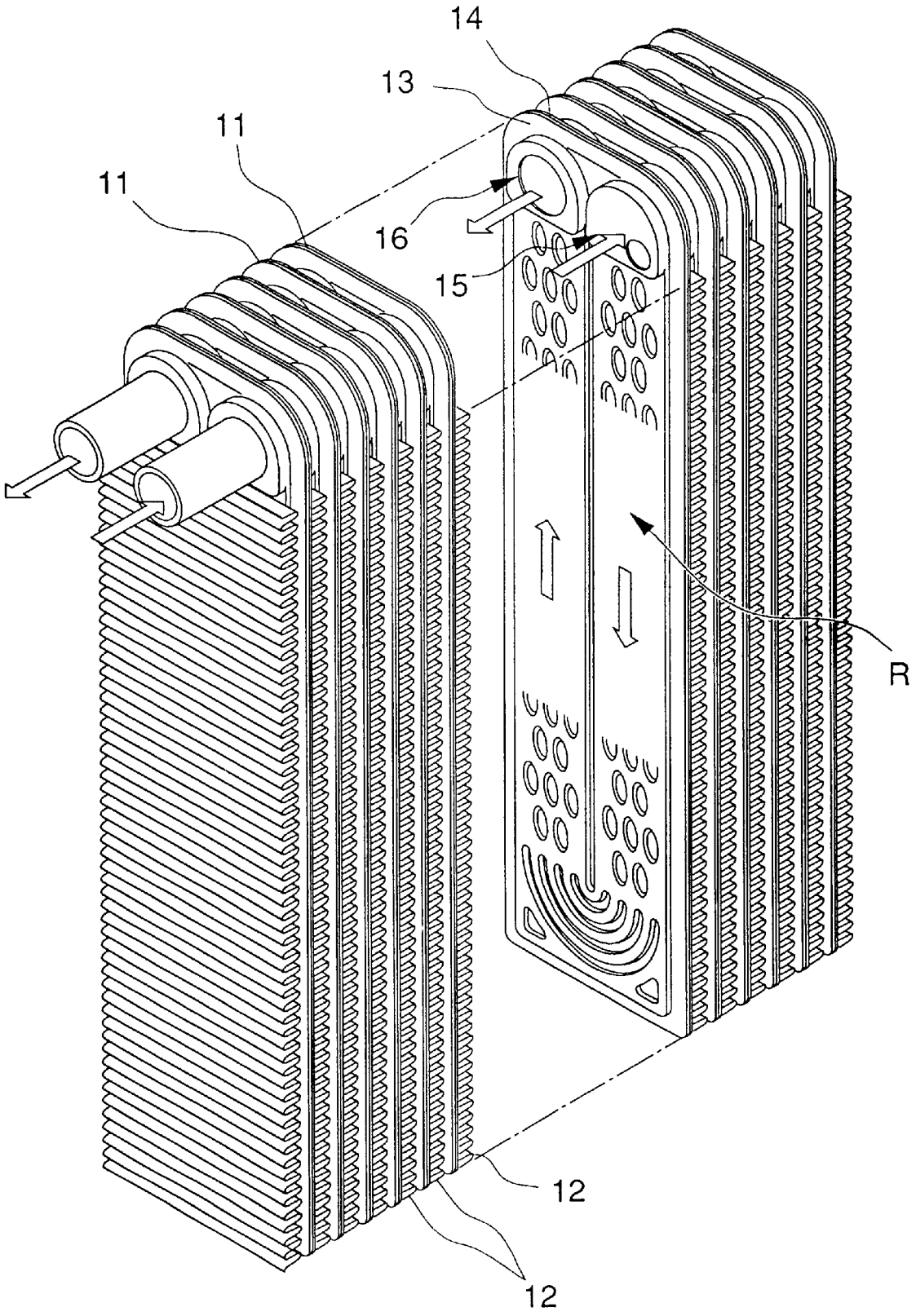
FIG. 17 is a perspective view showing the sixth example of a heat exchanger according to the present invention.
Figure 18:
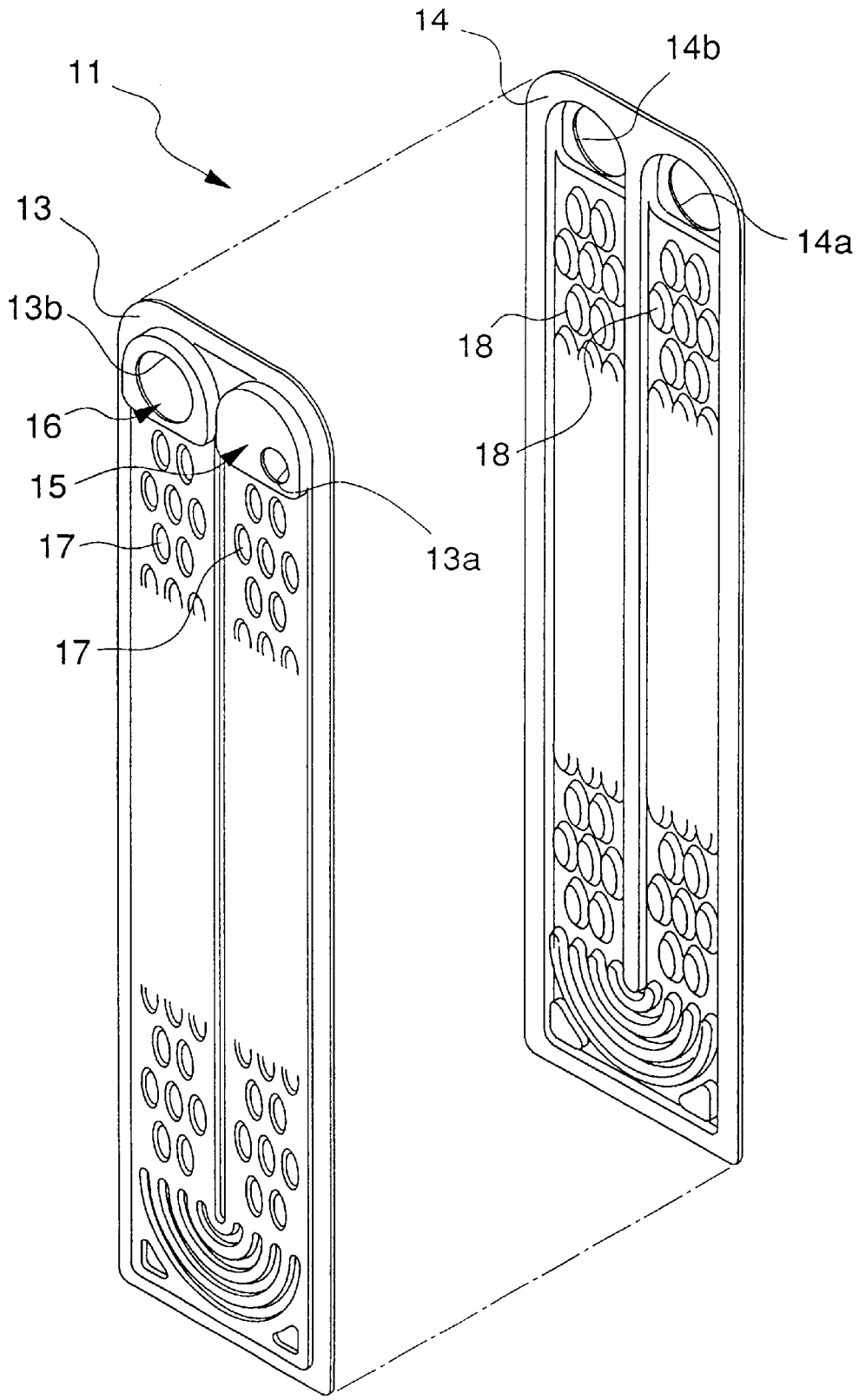
FIG. 18 is an exploded perspective view showing the cooling medium flow path which constitutes the heat exchanger of FIG. 17.
Figure 19:
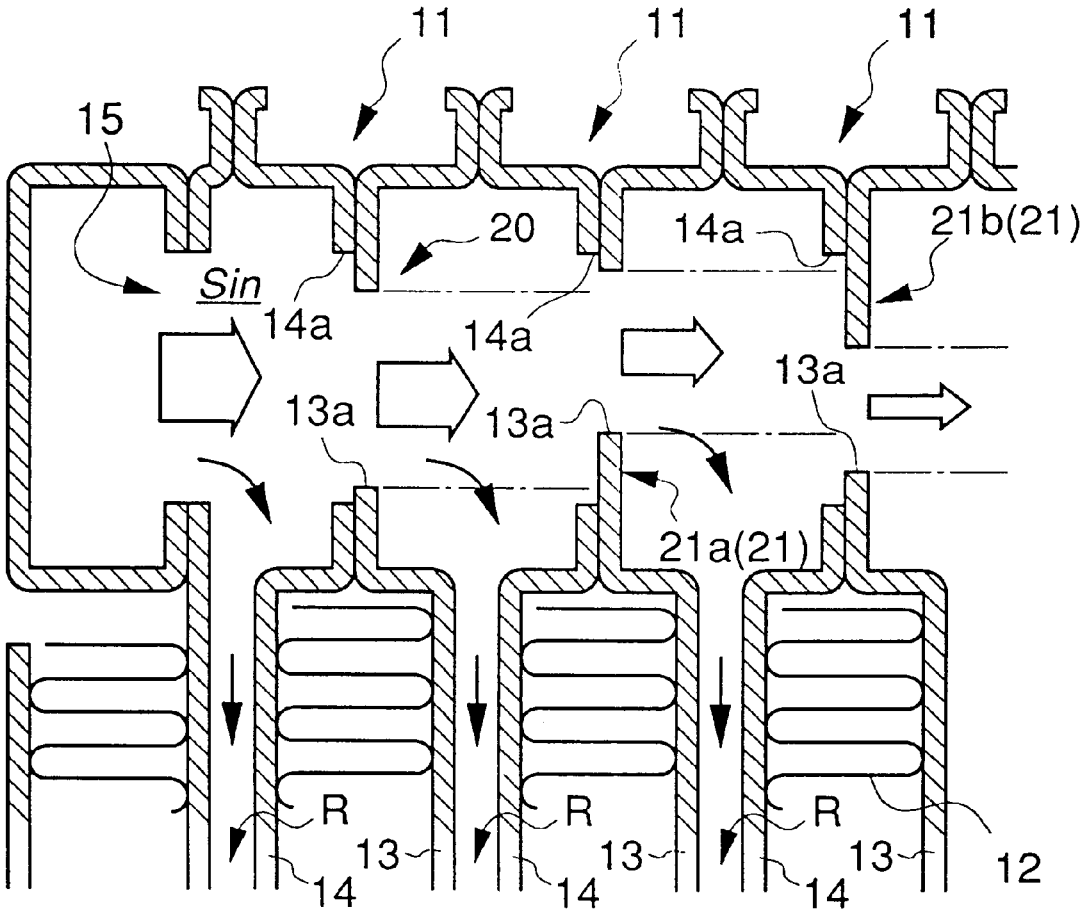
FIG. 19 is a cross-sectional view showing space on the inlet side and a cooling medium flow path connected to the space in the sixth example of the heat exchanger according to the present invention.

The sixth example of a heat exchanger according to the present invention will be described with reference to FIGS. 17 to 21. In the heat exchanger of the present example as shown in FIGS. 17 and 18 the opening portion 13*a* of a flat plate 13 which forms a cooling medium inlet 15 is formed in such a manner that it is smaller than the opening portion 14*a* of a flat plate 14 which also forms a cooling medium inlet 15 and the center of the opening portion 13*a* is shifted from the center of the opening portion 14*a*. Additionally, as shown in FIG. 19 the opening portions 14*a* in the respective cooling medium flow portions 11 are arranged at the same positions. On the other hand, the openings 13*a* in the respective cooling medium flow portions 11 are arranged at different positions. That is, the portion where the opening portion 13*a* is formed acts as a baffle plate 21 which hinders the flow of the cooling medium into the opening portion 14*a* in laminated cooling flow portions 11. Further, the opening portions 13*a* formed in adjacent baffle plates 21 are arranged in such a manner that they are not overlapped in the flow direction of the cooling medium.

In this heat exchanger a cooling medium flowing in the space Sin on the outlet side is passed through the opening portion 13*a* formed in each baffle plate 21 to flow downstream. On the other hand, a cooling medium which dose not pass through the opening portion 13*a* is guided by the baffle plate 21 to flow into the cooling medium flow path R. Further, since opening portions 13*a* formed in adjacent baffle plates 21 are arranged in such a manner that they do not overlap in the flow direction of the cooling medium, when for example a part of a cooling medium passing through the opening portion 13*a* of an upstream baffle plate 21*a* passes through the opening portion 13*a* of the adjacent downstream baffle plate 21*b*, it is hindered from flowing by the baffle plate 21*b* and cannot pass through the opening portion 13*a* whereby this part of the cooling medium is guided by the baffle plate 21*b* and flows into the cooling medium flow path R.

As described above, by arranging the opening portions 13*a* provided in the adjacent baffle plates so that they do not overlap, relatively much cooling medium is distributed to the cooling medium flow portion 11 positioned on the upstream side of the cooling medium flow portion 11 where the cooling medium was apt to remain. As the result, uniform heat exchange can be carried out by every one of the plurality of cooling flow portions, and the heat exchangeability of the heat exchanger is enhanced.

Figure 20:
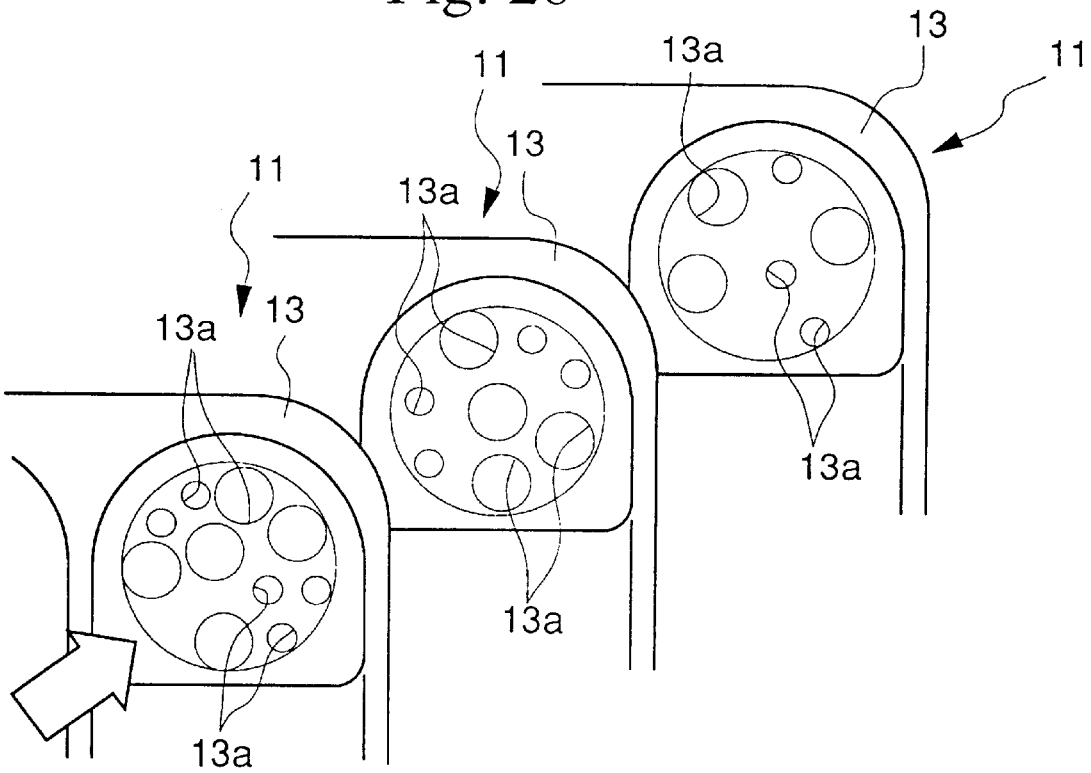
FIG. 20 is a bulged view of the respective baffle plates showing a modified example of the sixth example of the heat exchanger according to the present invention.

Incidentally, the number of opening portions 13*a* formed on the baffle plate 21 is not limited. For example, as shown in FIG. 20 a plurality of opening portions 13*a* having different sizes may be provided in the baffle plate 21.

Figure 21:
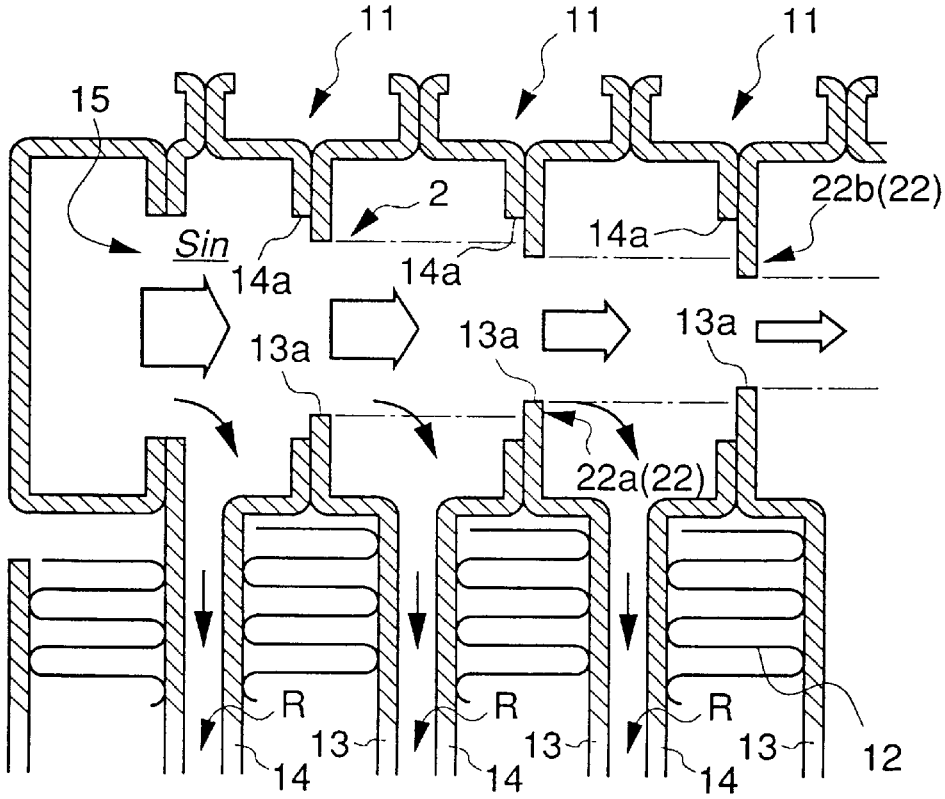
FIG. 21 is a cross-sectional view showing space on the inlet side and a cooling medium flow path connected to the space, that is a modified example of the sixth example of the heat exchanger according to the present invention.

Additionally, for example as shown in FIG. 21 the opening portion 13*a* of a baffle plate 22 positioned downstream in the flow direction of the cooling medium may be made smaller than that upstream. In this case, when, for example, a part of a cooling medium passing through the opening portion 13*a* of the upstream baffle plate 22*a* passes through the opening portion 13*a* of the adjacent downstream baffle plate 22*b*, it is hindered from flowing by the baffle plate 22*b* and cannot pass through the opening portion 13*a*, whereby this part of the cooling medium is guided by the baffle plate 22*b* and flows into the cooling medium flow path R. Therefore, even when the opening portion 13*a* of a downstream baffle plate 22 in the flow direction of the cooling medium is made smaller than that on the upstream side, relatively much cooling medium is distributed to the cooling medium flow portion 11 positioned upstream of the cooling medium flow portion 11 where a cooling medium was apt to remain. As the result, uniform heat exchange can be carried out in every one of the plurality of cooling flow portions and the heat exchangeability of the heat exchanger is enhanced.

EXAMPLE 7

The sixth example of a heat exchanger according to the present invention will be described with reference to FIGS. 22 to 24A, 24B.

A cooling medium flow portion is formed by laminating substantially rectangular flat plates 13 and 14 to braze them. The actual production of the heat exchanger is not performed by laminating a plurality of brazed cooling medium flow portions and again brazing them to join them, but by arranging brazing material-clad flat plates 13 and 14, and a cooling fin 12 in this order to laminate them, assembling them and other parts and placing the assembly in a heating oven (not shown) to heat and braze the respective portions.

Figure 22:
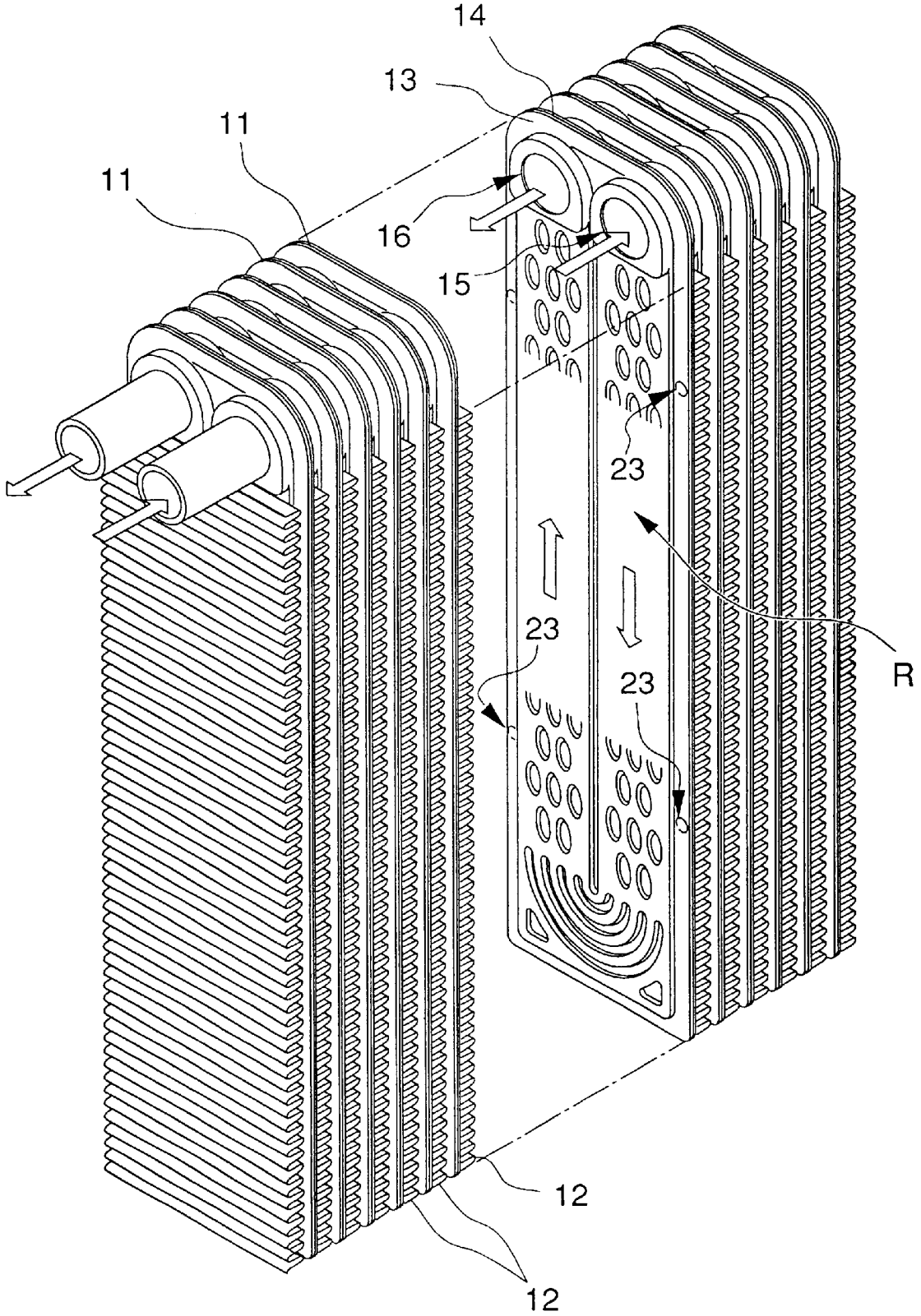
FIG. 22 is a perspective view showing the seventh example of a heat exchanger according to the present invention.
Figure 23:
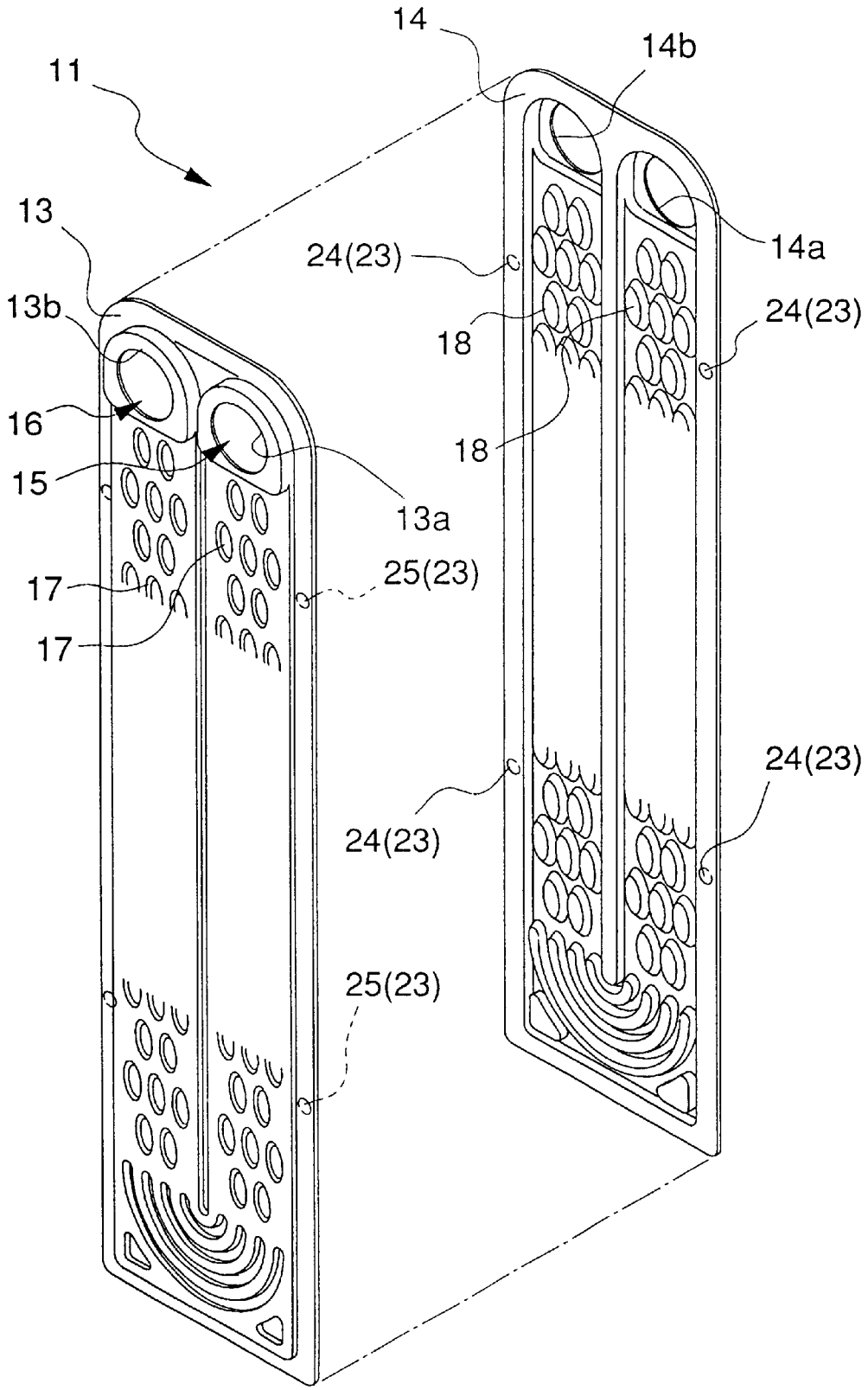
FIG. 23 is an exploded perspective view showing a cooling medium flow path which constitutes the heat exchanger of FIG. 22.
Figure 24A:
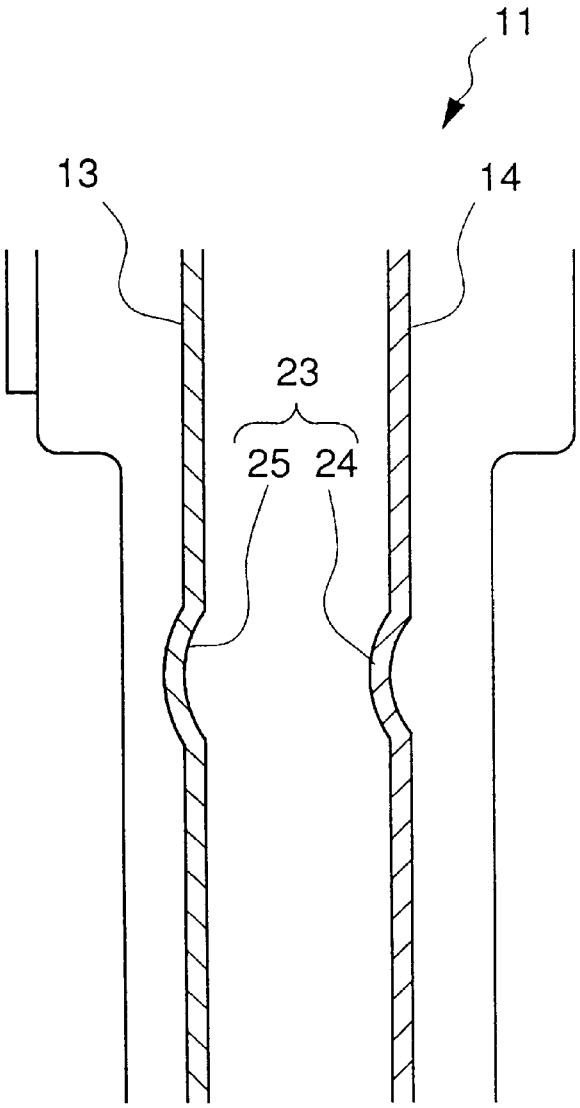
FIG. 24A is a state explanatory view showing the operation of registering two flat plates at a registering portion in a seventh example of a heat exchanger according to the present invention.
Figure 24B:
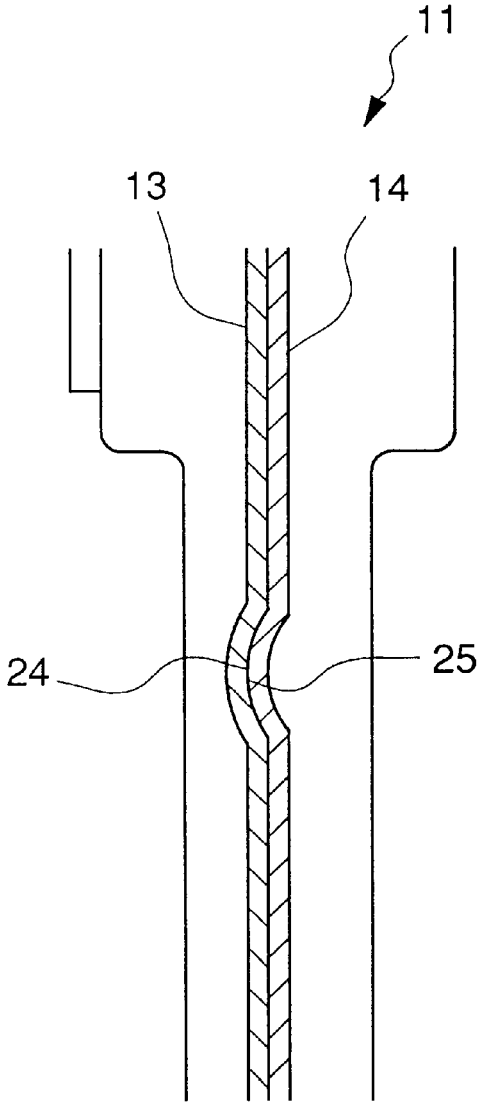
FIG. 24B is a state explanatory view showing the operation of registering two flat plates at a registering portion in a seventh example of a heat exchanger according to the present invention.
Figure 25:
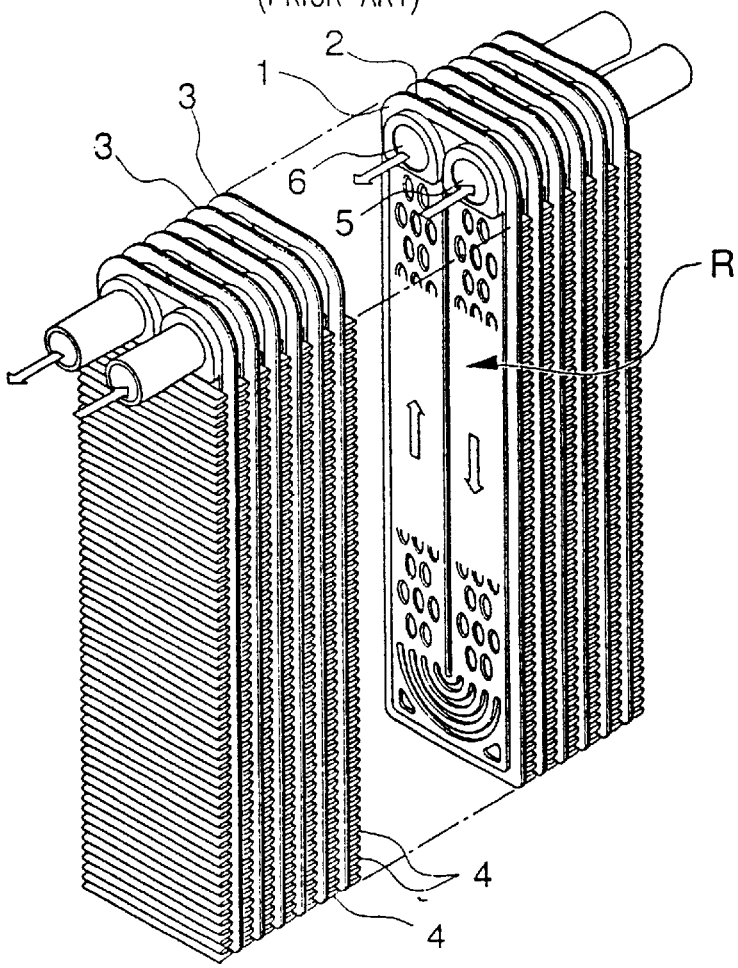
Fig. 25 (PRIOR ART)
FIG. 25 is a perspective view showing one example of a conventional evaporator.
Figure 26:
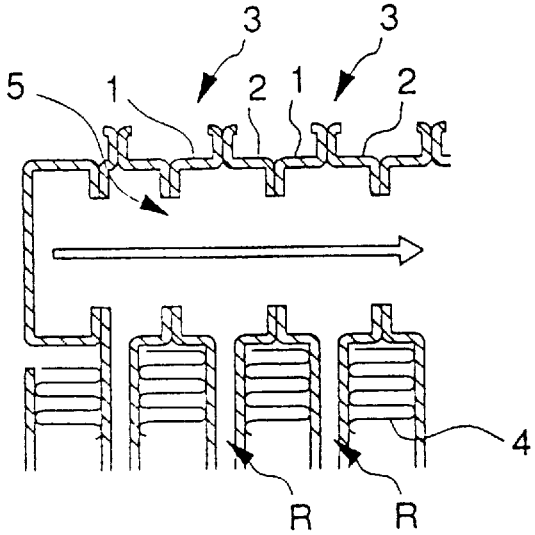
Fig. 26 (PRIOR ART)
FIG. 26 is a cross-sectional view showing space on the inlet side and a cooling medium flow path connected to the space in the conventional evaporator.

In this case the important point is registering the flat plates 13 and 14. However, in the heat exchanger of the present example a plurality of spaced positions of outer peripheral portions to be brazed in flat plates 13 and 14 are provided with register (positioning) portions 23 as shown in FIGS. 22 and 23. The register portion 23 is composed of a protrusion portion 24 formed in the flat plate 14 and a concave portion 25 formed in the flat plate 13 to be fitted to the protrusion portion 24 in a state where the flat plates 13 and 14 are laminated as shown in FIGS. 24A and 24B. Both protrusion portion 24 and concave portion 25 are formed when the flat plates 13 and 14 are subjected to drawing.

In this heat exchanger, by laminating the flat plates 13 and 14 thereby to fit the protrusion portion 24 to the concave portion 25 the registering of both the flat plates 13 and 14 can be performed. That is, when this register portions 23 are used, the conventional step of closing a claw is omitted and the material which is required for forming the claw is not needed. As a result, a reduction of assembly time and production costs can be made.

Further, since a plurality of register portions 23 is provided at the outer peripheral portions of the flat plates 13 and 14 to be brazed, the accuracy of registering is enhanced and production errors in the heat exchanger are kept at a lower level.

Additionally, since the protrusion portion 24 and the concave portion 25 are formed by drawing the flat plates 13 and 14, no excess material is needed and no excess steps for working them needed. Therefore, even if the register portions 23 are provided no excess production cost is required.

Incidentally, in the present example the protrusion portion 24 and the concave portion 25 a are respectively formed in the flat plates 14 and 13. However, the protrusion portion 24 and the concave portion 25 can be respectively formed in the flat plates 13 and 14. Alternatively, both protrusion portion 24 and concave portion 25 may be formed in the flat plate 13 or the flat plate 14 so that the flat plates 13 and 14 are laminated to fit to each other.

Further, in the present example the register portion 23 was formed by combining the protrusion portion 24 with the concave portion 25. Of course, the same effects can also be obtained by use of for example a hole instead of the concave portion 25. In this case if this hole is formed in the step of removing the flat plate 14 from a mold, no excess production cost is required.

Incidentally, in Examples 3 to 7 the respective bulged portions 18 diagonally adjacent to each other with respect to the flow direction of the cooling medium are arranged in a zigzag pattern as in Example 2 so that parts of the bulged portions overlap along the flow direction of the cooling medium and the respective cylindrical portions 19 are arranged accordingly.

Therefore, in Examples 3 to 7, in the cylindrical portions 19 which are diagonally adjacent to each other with respect to the flow direction of the cooling medium, the front end portion of a cylindrical portion 19 which is downstream of the rear end portion of an upstream cylindrical portion, becomes the upstream side of the flow direction. Accordingly, the local thermal conductivity which tends to be reduced at the rear end portion of the cylindrical portion 19 which is positioned upstream is compensated by the cylindrical portion 19 which is positioned downstream. As a result, the thermal conductivity of the entire cooling medium flow portion 11 is enhanced.

Additionally, the cylindrical portions 19 are regularly arranged along the flow direction of the cooling medium, and the joint portion of the top portions 18*a* can be widely ensured. Thus, the joint strength of the cooling medium flow portion can be enhanced. Therefore, even if the flat plates 13 and 14 are thin, sufficient pressure resistance is imparted to the cooling flow portion 11.

What is claimed is:

1. A heat exchanger in which a plate-shaped cooling medium flow portion, which provides an internal cooling medium flow path by laminating two flat plates formed by drawing, and a cooling fin are alternately laminated, said heat exchanger comprising:

a cooling medium inlet for allowing a cooling medium to flow into said cooling medium flow path and a cooling medium outlet for allowing said cooling medium passing through said cooling medium flow path to flow out are formed in said two flat plates;

a continuous space on the inlet side is formed by butting said cooling medium inlets of adjacent said cooling medium flow portions and a continuous space on the outlet side is formed by butting said cooling medium outlets of adjacent said cooling medium flow portions; and said cooling medium allowed to flow into said cooling medium inlet through said space on the inlet side and distributed to each of said cooling medium flow portions is passed through said cooling medium flow path and is allowed to flow out of said cooling medium outlet thereby to be discharged through said space on the outlet side, wherein relatively more of said cooling medium is distributed to said cooling medium flow portions at the upstream side than at the downstream side, and wherein a baffle plate having an opening portion for allowing said cooling medium to pass and guiding said cooling medium, which cannot pass through said opening portion, to said cooling medium flow path is provided for each of said cooling medium inlets for each of said cooling medium flow portions and an opening of a baffle positioned further downstream in the flow direction of said cooling medium is formed with a smaller size.

2. A heat exchanger in which a plate-shaped cooling medium flow portion, which provides an internal cooling medium flow path by laminating two flat plates formed by drawing, and a cooling fin are alternately laminated, said heat exchanger comprising:

a cooling medium inlet for allowing a cooling medium to flow into said cooling medium flow path and a cooling medium outlet for allowing said cooling medium passing through said cooling medium flow path to flow out are formed in said two flat plates;

a continuous space on the inlet side is formed by butting said cooling medium inlets of adjacent said cooling medium flow portions and a continuous space on the outlet side is formed by butting said cooling medium outlets of adjacent said cooling medium flow portions; and said cooling medium allowed to flow into said cooling medium inlet through said space on the inlet side and distributed to each of said cooling medium flow portions is passed through said cooling medium flow path and is allowed to flow out of said cooling medium outlet thereby to be discharged through said space on the outlet side, wherein relatively more of said cooling medium is distributed to said cooling medium flow portions at the upstream side than at the downstream side, and wherein a baffle plate having an opening portion for allowing said cooling medium to pass and guiding said cooling medium, which cannot pass through said opening portion, to said cooling medium flow path is provided for each of said cooling medium inlets for each of said cooling medium flow portions and said opening provided in adjacent said baffle plates are arranged so as not to overlap in the flow direction of said cooling medium.

3. A heat exchanger in which a plate-shaped cooling medium flow portion, which provides an internal cooling medium flow path by laminating two flat plates formed by drawing, and a cooling fin are alternately laminated, said heat exchanger comprising:

a cooling medium inlet for allowing a cooling medium to flow into said cooling medium flow path and a cooling medium outlet for allowing said cooling medium passing through said cooling medium flow path to flow out are formed in said two flat plates;

a continuous space on the inlet side is formed by butting said cooling medium inlets of adjacent said cooling medium flow portions and a continuous space on the outlet side is formed by butting said cooling medium outlets of adjacent said cooling medium flow portions; and said cooling medium allowed to flow into said cooling medium inlet through said space on the inlet side and distributed to each of said cooling medium flow portions is passed through said cooling medium flow path and is allowed to flow out of said cooling medium outlet thereby to be discharged through said space on the outlet side, wherein relatively more of said cooling medium is distributed to said cooling medium flow portions at the upstream side than at the downstream side, and wherein a flow path cross-section of said cooling medium flow path communicating with said space on the outlet side is gradually enlarged as said cooling medium flows toward the downstream in the flow direction of said cooling medium.

4. A heat exchanger in which a plate-shaped cooling medium flow portion, which provides an internal cooling medium flow path by laminating two flat plates formed by drawing, and a cooling fin are alternately laminated, said heat exchanger comprising:

a cooling medium inlet for allowing a cooling medium to flow into said cooling medium flow path and a cooling medium outlet for allowing said cooling medium passing through said cooling medium flow path to flow out are formed in said two flat plates;

a continuous space on the inlet side is formed by butting said cooling medium inlets of adjacent said cooling medium flow portions and a continuous space on the outlet side is formed by butting said cooling medium outlets of adjacent said cooling medium flow portions; and said cooling medium allowed to flow into said cooling medium inlet through said space on the inlet side and distributed to each of said cooling medium flow portions is passed through said cooling medium flow path and is allowed to flow out of said cooling medium outlet thereby to be discharged through said space on the outlet side, wherein relatively more of said cooling medium is distributed to said cooling medium flow portions at the upstream side than at the downstream side, and wherein a flow path cross-section of said cooling medium flow path communicating with said space on the inlet side is gradually reduced as said cooling medium flows downstream in the flow direction of said cooling medium.

5. A heat exchanger provided by alternately laminating a plate-shaped cooling medium flow portion which provides an internal cooling medium flow path by laminating two flat plates formed by drawing, and a cooling fin; the heat exchanger comprising:

a cooling medium inlet for allowing a cooling medium to flow into said cooling medium flow path and a cooling medium outlet for allowing said cooling medium passing through said cooling medium flow path to flow out are formed in said two flat plates;

a continuous space on the inlet side is formed by butting said cooling medium inlets of adjacent said cooling medium flow portions and a continuous space on the outlet side is formed by butting said cooling medium outlets of adjacent said cooling medium flow portions; and said cooling medium allowed to flow into said cooling medium inlet through said space on the inlet side and distributed to each of said cooling medium flow portions is passed through said cooling medium flow path and is allowed to flow out of said cooling medium outlet thereby to be discharged through said space on the outlet side, wherein relatively more of said cooling medium is distributed to said cooling medium flow portions at the upstream side than at the downstream side, wherein a restricting portion for restricting the flow of said cooling medium to guide a part of said cooling medium into said cooling medium inlet is provided in said space on the inlet side, and wherein said restricting portion is a protrusion which protrudes toward the upstream side in the flow direction of said cooling medium.

6. A heat exchanger according to claim 5, wherein said restricting portion is provided integrally with any one of said two flat plates.

7. A heat exchanger according to claim 5, wherein said restricting portion is provided integrally with any one of said two flat plates.

8. A heat exchanger according to claim 6, wherein said restricting portion is formed by being subjected to barring around said cooling medium inlet.

9. A heat exchanger according to claim 7, wherein said restricting portion is formed by being subjected to barring around said cooling medium inlet.

* * * * *